US005875380A

United States Patent [19]

Iwata et al.

[11] Patent Number: 5,875,380

[45] Date of Patent: Feb. 23, 1999

[54] IMAGE FORMING APPARATUS ELIMINATING INFLUENCE OF FLUCTUATION IN SPEED OF A CONVEYING BELT TO CORRECTION OF OFFSET IN COLOR REGISTRATION

[75] Inventors: Nobuo Iwata; Toshiya Sato; Tadashi Shinohara, all of Kanagawa; Yutaka Shio, Tottori, all of Japan

[73] Assignee: Ricoh Company, Ltd., Tokyo, Japan

[21] Appl. No.: 18,962

[22] Filed: Feb. 5, 1998

[30] Foreign Application Priority Data

Feb. 18, 1997 [JP] Japan ..... 9-033743
Apr. 14, 1997 [JP] Japan ..... 9-111962

[51] Int. Cl.[6] ..... G03G 15/01

[52] U.S. Cl. ..... 399/301

[58] Field of Search ..... 399/287, 298, 399/299, 300, 301, 303

[56] References Cited

U.S. PATENT DOCUMENTS

| | | | |
|---|---|---|---|
| 5,245,396 | 9/1993 | Ohshima et al. | 399/301 |
| 5,373,355 | 12/1994 | Ando et al. | 399/301 |
| 5,523,823 | 6/1996 | Ashikaga | 399/301 X |
| 5,550,625 | 8/1996 | Takamatsu et al. | 399/301 |
| 5,740,492 | 4/1998 | Deki et al. | 399/301 X |

FOREIGN PATENT DOCUMENTS

| | | |
|---|---|---|
| 63-271275 | 11/1988 | Japan . |
| 63-300261 | 12/1988 | Japan . |
| 1-142672 | 6/1989 | Japan . |
| 1-170958 | 7/1989 | Japan . |
| 6-18796 | 1/1994 | Japan . |
| 8-123129 | 5/1996 | Japan . |

*Primary Examiner*—Sandra Brase
*Attorney, Agent, or Firm*—Oblon, Spivak, McClelland, Maier & Neustadt, P.C.

[57] ABSTRACT

An image processing apparatus eliminates a detection error in a color offset detecting operation due to a periodic fluctuation in a speed of a conveying belt which conveys a transfer sheet on which color component images are transferred and superimpose to form a multi-color image. A plurality of image forming units are arranged along the conveying belt, each of the image forming units transferring a color component image on the transfer sheet and also transferring a register mark on the conveying belt. A register mark detecting sensor located along the conveying belt detects the register mark on the conveying belt. A distance between the register mark detecting sensor and one of the plurality of image forming units adjacent to the register mark detecting sensor is a multiple of an integer of a circumference of the drive roller. A distance between adjacent ones of the plurality of image forming units is a multiple of an integer of the circumference of the drive roller.

9 Claims, 16 Drawing Sheets

FIG. 9
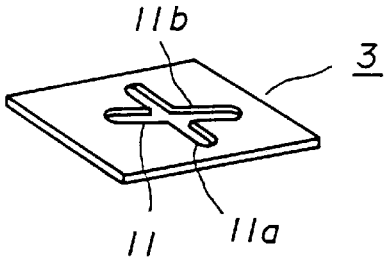
FIG. 10A
FIG. 10B
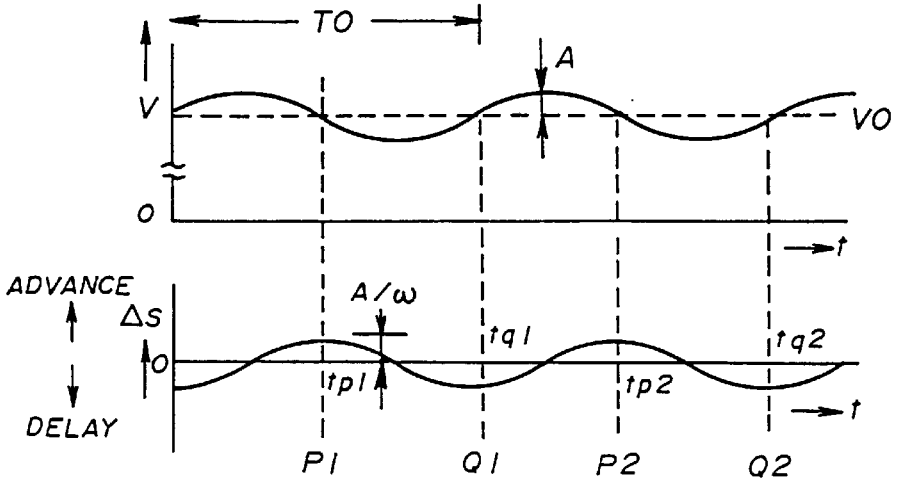

IMAGE FORMING APPARATUS ELIMINATING INFLUENCE OF FLUCTUATION IN SPEED OF A CONVEYING BELT TO CORRECTION OF OFFSET IN COLOR REGISTRATION

BACKGROUND OF THE INVENTION

1. Field of the Invention

The present invention relates to a multi-color image forming apparatus such as an electrophotographic apparatus and, more particularly, to a multi-color image forming apparatus in which a plurality of color component images are sequentially transferred and superimposed on a recording medium carried by a conveying belt.

2. Description of the Related Art

In an image forming apparatus such as a multi-color printer or a multi-color copy machine, a plurality of image forming units are serially arranged along a conveying belt, the image forming units form color component toner images corresponding to yellow, magenta, cyan and black. Each of the color component images are transferred and superimposed on a transfer sheet conveyed by a conveying belt so that a multi-color or full-color image is formed. In the above-mentioned image forming apparatus such as an electrophotographic apparatus, it is required to accurately superimpose color component images without an offset with respect to each other so as to form a high-quality color image.

Japanese Laid-Open Patent Application No. 6-18796 discloses an image forming apparatus which corrects a color offset with respect to a reference color (black, for example) by forming register marks corresponding to color component images on a conveying belt and detecting the register marks by a CCD sensor.

Additionally, Japanese Laid-Open Patent Application No. 8-123129 discloses an image forming apparatus similar to the image forming apparatus disclosed in the above-mentioned patent document. The image forming apparatus disclosed in Japanese Laid-Open Patent Application No. 8-123129 further comprises a stain preventing member which prevents formation of a stain on the register marks.

Each of the above-mentioned conventional image forming apparatuses is structured as shown in FIG.1. That is, an image forming unit 20Y, an image forming unit 20M, an image forming unit 20C and an image forming unit 20K are arranged along a conveying belt 35 which is drivingly engaged with a drive roller 36 and an idle roller 37. The image forming units 20Y, 20M, 20C and 20K form a yellow toner image, a magenta toner image, a cyan toner image and a black toner image, respectively.

Additionally, a paper supply cassette 40 which stores transfer papers is provided under the conveying belt 35. A paper supply roller 41 which feeds the transfer paper is provided on an end portion of the paper supply cassette 40. A register roller 42 which feeds the transfer paper to the conveying belt 35 is provided near the image forming unit 20Y. A fixing roller 43 and a pressing roller 44 which fix a toner image formed on the transfer paper are provided near the drive roller 36.

The image forming unit 20Y comprises a photosensitive drum 1Y, a charger 30Y, an optical writing unit 31Y, a developing unit 32Y, a transfer unit 33Y, and a cleaning unit 34Y. The charger 30Y charges the photosensitive drum 1 so that an electrostatic latent image is formed on the photosensitive drum 1Y by the optical writing unit 31Y. The developing unit 32Y develops the latent image as a yellow (Y) toner image. The Y toner image is transferred to transfer paper. The cleaning unit 34Y removes toner remaining on the photosensitive drum 1Y.

Similarly, the image forming unit 20M comprises a photosensitive drum 1M, a charger 30M, an optical writing unit 31M, a developing unit 32M, a transfer unit 33M, and a cleaning unit 34M. The image forming unit 20C comprises a photosensitive drum 1C, a charger 30C, an optical writing unit 31C, a developing unit 32C, a transfer unit 33C, and a cleaning unit 34C. The image forming unit 20K comprises a photosensitive drum 1K, a charger 30K, an optical writing unit 31K, a developing unit 32K, a transfer unit 33K, and a cleaning unit 34K.

In the above-mentioned structure, a position offset sensor 45 is provided near the drive roller 36. The position offset sensor 45 detects register marks formed by the image forming units 20Y, 20M, 20C and 20K. A discharger 38 is provided on the downstream side of the position offset sensor 45 so as to discharge the conveying belt 35. A cleaning unit 39 is provided near the idle roller 37 so as to remove toner remaining on the conveying belt 35.

In the above-mentioned conventional image forming apparatus, the Y toner image is transferred onto a transfer paper by the image forming unit 20Y so that the Y toner image is transferred in synchronization with the conveyance of the transfer paper by the transfer belt 35. The transfer paper having the Y toner image is conveyed to a position corresponding to the image forming unit 20M. Then, a magenta (M) toner image is transferred and superimposed on the Y toner image by the image forming unit 20M. Similarly, a cyan (C) toner image is transferred and superimposed on the M toner image and, then, a black (K) toner image is transferred on the M toner image. Accordingly, a multi-color or full-color image is formed by the superimosingly transferred Y toner image, M toner image, C toner image and K toner image being superimposed. The multi-color image is fixed on the transfer paper by being passed through a portion between the fixing roller 43 and the pressing roller 44.

In the above-mentioned image forming process, register marks corresponding to each color of the image forming units 20Y, 20M, 20C and 20K are formed and developed on an area of each of the photosensitive drums 1y, 1M, 1C and 1K, respectively. The register marks are transferred to the conveying belt 35 in synchronization with a transfer operation of each of the Y, M, C and K toner images by the respective transfer units 33Y, 33M, 33C and 33K. Then, the register marks in each color are read by the position offset sensor 45 so as to detect an offset of the register marks corresponding to Y, M and C with respect to K. A writing position of each of the optical writing units 31Y, 31M, and 31C is adjusted so as to correct the offset detected by the position offset sensor 45.

In the above-mentioned conventional image forming apparatus, since the endless conveying belt 35 is driven by the drive roller 36, speed of the conveying belt 35 periodically fluctuates due to an eccentricity of the drive roller 36 or an eccentricity of rotational force transmitting parts such as a gear for transmitting a rotational force to the drive roller 36.

When such a periodic fluctuation occurs in the speed of the conveying belt 35, the register marks are formed at positions slightly offset from accurate positions in which the register marks are to be formed since the operation of forming the register marks is performed on the assumption that the conveying belt 35 is moving at a constant speed. Accordingly, the register marks are detected by the position offset sensor 45 at slightly offset positions. Thus, there is a problem in that an accurate detection of the offset in the positions of the register marks cannot be performed due to the periodic fluctuation in the speed of the conveying belt 35.

A description will now be given of another conventional image forming apparatus in which a color offset is corrected by detecting a position offset of a register mark corresponding to each color component image.

FIG. 2 is an illustration of a structure of a conventional color image forming apparatus. In FIG. 2, parts that are the same as the parts shown in FIG. 1 are given the same reference numerals, and descriptions thereof will be omitted. The color image forming apparatus shown in FIG. 2 has the same structure with the image forming apparatus shown in FIG. 1 except for the position offset sensor 45 being replaced with a register mark detecting sensor 14 located on the same side where the image forming units 20Y, 20M, 20C and 20K are located.

In the color image forming apparatus shown in FIG. 2, a recording paper (transfer sheet) 10 is fed onto the conveying belt 35 from the paper cassette 40. The recording paper 10 is secured on the conveying belt 35 by an electrostatic force, and conveyed to the image forming unit 20Y so that an yellow toner image is formed on the recording paper 10. Thereafter, a magenta toner image, a cyan toner image and a black toner image are sequentially and formed and superimposed by the respective image forming units 20M, 20C and 20K. After the black toner image is formed by the image forming unit 20K, the recording paper 10 is passed through the fixing unit comprising the fixing roller 43 and the pressing roller 44 so that the toner image on the recording paper 10 is fixed, and then the recording paper 10 is ejected to a paper eject tray (not shown in the figure). It should be noted that operations of the optical writing units 31Y, 31M, 31C and 31K are controlled by a control unit 53 so that the Y, M, C and K toner images are accurately formed on the respective photosensitive drums 1Y, 1M, 1C and 1K.

FIG. 3A is a perspective view of a part of the color image forming apparatus shown in FIG. 2. In FIG. 3A, a direction indicated by an arrow B (hereinafter referred to as direction B) is perpendicular to a moving direction of the conveying belt 35 indicated by an arrow C (hereinafter referred to as direction C). That is, the direction B corresponds to a primary scanning direction, and the direction C corresponds to a secondary scanning direction. In the color image forming apparatus, if a distance between the image forming units 20Y, 20M, 20C, and 20K or an angle of each of the image forming units 20Y, 20M, 20C and 20K is shifted from a correct position, this causes a color offset (an offset in a registration of color component images) in the output image and results in deterioration of the output image quality. Accordingly, in the color image forming apparatus, each of the image forming units 20Y, 20M, 20C and 20K forms a register mark 15 on the conveying belt 35 so that an offset in a registration of color component images can be detected. The correction is performed based on the offset in the registration of each of the color component images by detecting the register mark 15 formed by each of the image forming units 20Y. 20M, 20C and 20K. The register mark 15 and the register mark detecting sensor 14 are shown in FIG. 3A. The register marks 15 are formed on each side of the conveying belt 35. Thus, the register mark detecting sensor 14 is provided on each side of the conveying belt 35 on the downstream side of the image forming unit 20K so as to detect the register marks 15 formed on the conveying belt 35.

FIG. 3B is a perspective view of the register mark detecting sensor 14. Each of the register marks 15 comprises a mark extending in the direction B perpendicular to the direction C of the movement of the conveying belt 35 and a mark inclined a predetermined angle (for example, 45 degrees) with respect to the direction B. Each of the register mark detecting sensors 14 is located in a position where the register marks 15 can be detected. Hereinafter, a description will be give to one of the register mark detecting sensors 14 since they are identical to each other. The register mark detecting sensor 14 detects a time when the register mark 15 passes the position of the register mark detecting sensor 14. The register position offset of each register mark 15 is obtained based on the time of passage of each register mark 15.

The register mark detecting sensor 14 comprises a light-emitting diode (LED) 14-1, a slit plate 14-2 and a light-receiving element 14-3. The LED 14-1 is located on the side of the conveying belt 35 where the register mark 15 is formed so as to project a light to the register mark 15. The slit plate 14-2 and the light-receiving element 14-3 are located on the opposite side of the conveying belt 35, that is, an inner side of a loop formed by the conveying belt 35. The slit plate 14-2 has a slit having a shape the same as that of the register mark 15 so that the light projected from the LED 14-1 passes therethrough. The light-receiving element 14-3 receives the light passing through the slit of the slit plate 14-2. Accordingly, the light-receiving element 14-3 receives the light projected from the LED 14-1 when the register mark 15 is not present. On the other hand, the light-receiving element 14-3 receives a reduced light when the register mark 15 passes directly above the slit plate 14-2. The light-receiving element 14-3 detects the time when the register mark 15 passes by a difference in the amount of received light.

FIG. 4A is an illustration showing a positional relationship between the register mark detecting sensor 14 and the register mark 15 comprising a pair of marks K1 and K2 formed by the image forming unit 20K (black) and a pair of marks C1 and C2 formed by the image forming unit 20C (cyan). When the mark K1 or C1 is aligned with the slit extending in the direction B, or when the line mark K2 or C2 is aligned with the slit inclined with respect to the direction B, an amount of light received by the light-receiving element 14-3 is minimized. FIG. 4B is a time chart showing a peak of a detection signal output by the register mark detecting sensor 14. The peak indicates a time when the amount of light received by the register mark detecting sensor 14 is minimized. Accordingly, time TK1, TK2, TC1 and TC2 correspond to time when the corresponding marks K1, K2, C1 and C2 pass the register mark detecting sensor 14.

An offset of a register position of the cyan toner image with respect to a reference color toner image (black, in this case) can be obtained by the following relationship, where V0 is a speed of movement of the register mark 15, that is, a speed of movement of the conveying belt 35; and T0 is a time difference between the time when the mark K1 is detected and the time when the mark C1 is detected. It should be noted that an angle of the marks K2 and C2 with respect to the respective mark K1 and C1 is 45 degrees.

An amount E of the offset of a position of the cyan tone image in the primary scanning direction (direction B) with respect to the reference color toner image (black) is represented by the following relationship.

$$E=\{(TC2-TC1)-(TK2-TK1)\}\times V0 \quad (1)$$

An amount F of the offset of the position of the cyan toner image in the secondary scanning direction (direction C) with respect to the reference color toner image (black) is represented by the following relationship.

$$F=\{(TC2-TC1)-T0)\}\times V0 \quad (2)$$

A description will now be given of a more specific example. It is now assumed that the cyan marks C1 and C2 are spaced from the respective line marks K1 and K2 by a distance of 30 mm in the secondary scanning direction so that the mark K2 (black) does not cross the mark C1 (cyan). Accordingly, if the marks C1 and C2 are shifted toward the marks K1 and K2 by the distance of 30 mm, the line marks C1 and C2 coincide with the respective marks K1 and K2. That is, the cyan marks C1 and C2 do not have a position offset with respect to the black marks K1 and K2.

In FIGS. 4A and 4B, if V0=100 mm/sec; TK1=0 sec; TK2=0.1 sec; TC1=0.3 sec; TC2=0.4 sec; and T0=0.3 sec, this means that a distance between marks K1 and K2 is 10 mm; a distance between marks K1 and C1 is 30 mm; and a distance between marks K1 and C2 is 40 mm. In this condition, an amount of offset of position in the primary scanning direction and the secondary scanning direction can be calculated by the above relationships (1) and (2) as follows.

$$E=\{(0.4-0.3)-(0.1-0)\}\times 100=0 \text{ mm}$$

$$F=\{(0.3-0)-0.3\}\times 100=0 \text{ mm}$$

As appreciated from above, no offset of position is present in both the primary scanning direction and the secondary scanning direction.

FIGS. 5A and 5B correspond to FIGS. 4A and 4B, respectively, in a case when an offset of position is generated in both the primary scanning direction and the secondary scanning direction. It should be noted that, in FIGS. 5A and 5B, the offset of position is emphasized for the sake of easy recognition.

In FIGS. 5A and 5B, if V0=100 mm/sec; TK1=0 sec; TK2=0.1 sec; TC1=0.301 sec; TC2=0.4015 sec; and T0=0.3 sec, this means that a distance between marks K1 and K2 is 10 mm; a distance between marks K1 and C1 is 30.1 mm; and a distance between marks K1 and C2 is 40.15 mm. In this condition, an amount of offset of position in the primary scanning direction and the secondary scanning direction can be calculated by the above relationships (1) and (2) as follows.

$$E=\{(0.4015-0.301)-(0.1-0)\}\times 100=0.05 \text{ mm}=50\ \mu\text{m}$$

$$F=\{(0.301-0)-0.3\}\times 100=0.1 \text{ mm}=100\ \mu\text{m}$$

As appreciated from the above, the amount E of the offset of position in the primary scanning direction is 50 $\mu$m, and the amount F of the position offset in the secondary scanning direction is 100 $\mu$m.

As mentioned above, the position offset of each color register mark with respect to the reference color register mark can be calculated by detecting the time when each register mark 15 passes the register mark detecting sensor 14. Accordingly, an appropriate correction can be performed for a timing of the image forming operation so as to achieve an accurate registration of the register position.

The above mentioned calculation of the amount of position offset is based on the assumption that the speed V0 of movement of the conveying belt 35 is constant. However, in practice, there is a fluctuation in the speed of movement of the conveying belt 35 due to a fluctuation in a rotational speed of the drive roller or an eccentricity of the circumference of the drive roller with respect to the rotational axis thereof. If the speed of the conveying speed fluctuates, an error may be generated in the calculated amounts E and F of the offset of position.

FIG. 6 is a graph of a speed V of movement in which a periodic fluctuation is generated. In FIG. 6, an average speed V0 of movement of the conveying belt 35 is 100 mm/sec, and a periodic fluctuation of about ±0.2 mm/sec is generated.

Consideration is given to a case in which the above-mentioned marks K1, K2, C1 and C2 are detected when the periodic fluctuation is generated in the speed of movement of the conveying belt 35 as shown in FIG. 6. A positional relationship between the marks K1, K2, C1 and C2 is the same as that shown in FIG. 4A. That is, the distance between marks K1 and K2 is 10 mm; the distance between marks K1 and C1 is 30 mm; and the distance between marks K1 and C2 is 40 mm. Thus, if the marks C1 and C2 are shifted toward the marks K1 and K2 by the distance 30 mm, the marks C1 and C2 coincide with the respective marks K1 and K2.

In FIG. 6, a time t when the mark K1 is detected zero (t=0), the speed V(t) of movement of the conveying belt 35 is represented by the following relationship.

$$V(t)=V0+V1\times\cos(\omega t) \quad (3)$$

Where, V0=100 mm/sec; V1=0.2 mm/sec; and $\omega=2\pi/1.2$ rad/sec.

Additionally, a length L(t) of the conveying belt which passes the register mark detecting sensor 14 can be calculated by integrating the speed of movement L(t) with respect to the time. The result of the integration is as follows.

$$L(t)=V0\times t+(V1/\omega)\times\sin(\omega t) \quad (4)$$

With respect to the time when the marks K2, C1 and C2 are detected, the time should satisfy the condition such as L(t)=10 mm; L(t)=30 mm; and L(t)=40 mm. For example, this condition is satisfied if TK1=0 sec; TK2=0.09981 sec; TC1=0.29962 sec and TC2=0.39967 sec. Additionally, the amount of position offset is obtained by the relationships (1) and (2) as follows.

$$E=0.024 \text{ mm}=24\ \mu\text{m}$$

$$F=-0.038 \text{ mm}=-38\ \mu\text{m}$$

As mentioned above, although the register marks shown in FIG. 4A are supposed to have no position offset in either the primary scanning direction or the secondary scanning direction, there is a detection error due to a fluctuation in the moving speed of the conveying belt that cannot be neglected. That is, there is a problem in that an error is generated due to a fluctuation in the moving speed of the conveying belt when an amount of position offset is calculated by detecting the register mark on the conveying belt.

SUMMARY OF THE INVENTION

It is a general object of the present invention to provide an improved and useful image forming apparatus in which the above-mentioned problems are eliminated.

A more specific object of the present invention is to provide an image processing apparatus which eliminates a detection error in a color offset detecting operation due to a periodic fluctuation in a speed of movement of a conveying belt which conveys a transfer sheet on which color component images are transferred and superimposed to form a multi-color image.

In order to achieve the above-mentioned objects, there is provided according to the present invention an image forming apparatus for forming a multi-color image which is formed by transferring and superimposing a plurality of color component images on a transfer sheet, the image forming apparatus comprising:

an endless conveying belt conveying the transfer sheet, the conveying belt being driven by a drive roller;

a plurality of image forming units arranged along the conveying belt, each of the image forming units transferring a color component image on the transfer sheet and also transferring a register mark on the conveying belt; and a register mark detecting sensor located along the conveying belt for detecting the register mark on the conveying belt, wherein a distance between the register mark detecting sensor and one of the plurality of image forming units adjacent to the register mark detecting sensor is a multiple of an integer of a circumference of the drive roller; and a distance between adjacent ones of the plurality of image forming units is a multiple of an integer of the circumference of the drive roller.

According to the above-mentioned invention, the register mark is transferred on the conveying belt by the image forming units, and the register mark on the conveying belt is detected by the register mark detecting sensor. The distance from the register mark detecting sensor to each of the image forming units is a whole number multiple of the circumference of the drive roller. Thus, if there is a position offset when the register mark is transferred on the conveying belt due to a periodic fluctuation in the moving speed of the drive roller, the position offset is canceled when the register mark is detected by the register mark detecting sensor since the same position offset is present when the register mark detecting sensor detects the register mark. Therefore, influence of the periodic fluctuation in the moving speed of the conveying belt is automatically eliminated, resulting in a highly accurate detection of a color offset so as to perform an appropriate color offset correction.

The image forming apparatus according to the present invention may further comprise a rotational force transmitting mechanism which includes a motor and an intermediate rotational member so that a rotational force of the motor is transmitted to the drive roller of the conveying belt via the intermediate rotational member, wherein the motor and the intermediate rotational member are rotated a multiple of an integer of turns while the drive roller rotates a single turn.

According to this invention, since the motor and the intermediate rotational member are rotated a whole number of turns while the drive roller rotates a single turn, a fluctuation caused by the rotational force transmitting mechanism occurs in the same position of each cycle of the periodic fluctuation in the moving speed of the conveying belt. Thus, an influence of the fluctuation caused by the rotational force transmitting mechanism is also canceled.

In one embodiment of the present invention, the distance between the register mark detecting sensor and one of the plurality of image forming units adjacent to the register mark detecting sensor may be equal to the circumference of the drive roller, and the distance between adjacent ones of the plurality of image forming units may be equal to the circumference of the drive roller.

Additionally, the plurality of image forming units may be located on one side of a loop of the conveying belt, and the register mark sensor may be located on the other side of the loop of the conveying belt.

There is provided according to another aspect of the present invention an image forming apparatus for forming a multi-color image which is formed by transferring and superimposing a plurality of color component images on a transfer sheet, the image forming apparatus comprising:

an endless conveying belt conveying the transfer sheet, the conveying belt being driven by a drive roller;

a plurality of image forming units arranged along the conveying belt, each of the image forming units transferring a color component image on the transfer sheet and also transferring a register mark on the conveying belt;

a register mark detecting sensor located along the conveying belt for detecting the register mark on the conveying belt; and a control unit controlling the image forming units so that one of the image forming units forms a first register mark and a second register mark a first predetermined distance away from the first register mark and another one of the image forming units forms a third register mark and a fourth register mark so that the third register mark is formed a second predetermined distance away from the first register mark and the fourth register mark is formed a second predetermined distance away from the second register mark, the first predetermined distance being substantially equal to a distance corresponding to a n/2 rotation of the driving roller, n being an integer, wherein an amount of offset of registration of color component images transferred by the image forming units is determined based on an average value of a first amount of offset and a second amount of offset, the first amount of offset being detected based on a pair of the first register mark and the third register mark, the second amount of offset being detected based on a pair of the second register mark and the fourth register mark.

According to the above-mentioned invention, the pair of the first and third register marks are formed the first predetermined distance away form the pair of second and fourth register marks. Since the first predetermined distance corresponds to a n/2 rotation of the driving roller, if the pair of the first and third register marks are formed on the plus side of a periodic fluctuation in the moving speed of the conveying roller caused by the driving roller, the pair of the second and fourth register marks are formed on the minus side of the periodic fluctuation. Thus, an offset due to the periodic fluctuation is canceled by averaging the offset obtained from the pair of the first and third register marks and the offset obtained from the pair of the second and fourth register marks. Accordingly, influence of the periodic fluctuation can be eliminated, which enables an accurate correction of a registration offset of the color component images.

In one embodiment of the present invention, the first distance may correspond to a ½ rotation of the driving roller. Additionally, each of the first, second, third and fourth register marks comprises a first mark and a second mark a third predetermined distance away from the first mark, the first mark extending in a direction perpendicular to a direction of movement of the conveying belt, the second mark extending in a direction inclined with respect to the direction of movement of the conveying belt.

There is provided according to another aspect of the present invention an image forming apparatus for forming a multi-color image which is formed by transferring and superimposing a plurality of color component images on a transfer sheet, the image forming apparatus comprising:

an endless conveying belt conveying the transfer sheet, the conveying belt being driven by a drive roller in a first direction corresponding to a direction of conveyance of the transfer sheet;

a plurality of image forming units arranged along the conveying belt, each of the image forming units transferring a color component image on the transfer sheet and also transferring a register mark on the conveying belt;

a register mark detecting sensor unit located along the conveying belt for detecting the register mark on the conveying belt, the register mark detecting sensor unit comprising a first register mark detecting sensor and a second register mark detecting sensor arranged along a direction of movement of the conveying belt, the second register mark detecting sensor apart from the first register mark detecting sensor by a predetermined short distance; and a control unit controlling the image forming units so that a first register mark is formed by one of the image forming units and a second register mark is formed by another one of the image forming units so that the second register mark is apart from the first register mark by a distance substantially equal to the predetermined distance, wherein the first register mark and the second register mark are detected by the first register mark sensor and the second register mark sensor substantially at the same time so that an amount of offset of registration of color component images transferred by the image forming units is determined based on a time difference between a detection of the first register mark and a detection of the second register mark.

According to this invention, since an amount of offset of the second register mark with respect to the first register mark is detected by two register mark detecting sensors adjacent to each other, there is less influence of a periodic fluctuation in a moving speed of the conveying belt. That is, since the amount of offset is determined based on the time difference between the detections of the first register mark and the second register mark which are also formed with a short distance corresponding to the distance between the register mark detecting sensors, influence of the periodic fluctuation which has a relatively greater period than the distance between the register mark detecting sensors can be minimized. Thus, an accurate correction of a registration offset of the color component images can be achieve.

In one embodiment of the present invention, the first register mark may comprise a first mark extending in a second direction perpendicular to the first direction, a second mark extending in a direction inclined with respect to the first direction and a third mark extending in the second direction, the second mark spaced apart from the first mark by a distance equal to the predetermined distance of the register mark detecting sensor unit, the third mark spaced apart from the first mark by a distance corresponding to four times the predetermined short distance;

the second register mark may comprise a fourth mark extending in a second direction perpendicular to the first direction, a fifth mark extending in a direction inclined with respect to the first direction and a sixth mark extending in the second direction, the fifth mark spaced apart from the fourth mark by a distance equal to the predetermined short distance of the register mark detecting sensor unit, the sixth mark spaced apart from the fourth mark by a distance corresponding to four times the predetermined short distance; and the fourth mark of the second register mark may be spaced apart from the first mark of the first register mark by a distance corresponding to two times the predetermined short distance.

Other objects, features and advantages of the present invention will become more apparent from the following detailed description when read in conjunction with the accompanying drawings.

BRIEF DESCRIPTION OF THE DRAWINGS

FIG. 9 is a perspective view of a silt plate included in a position offset sensor shown in FIG. 7;

FIG. 10A is a time chart for showing a periodic fluctuation of a moving speed of a conveying belt due to an eccentricity in a drive roller; FIG. 10B is a time chart of a position offset calculated based on the moving speed shown in FIG. 10A;

DETAILED DESCRIPTION OF THE PREFERRED EMBODIMENTS

Figure 1:
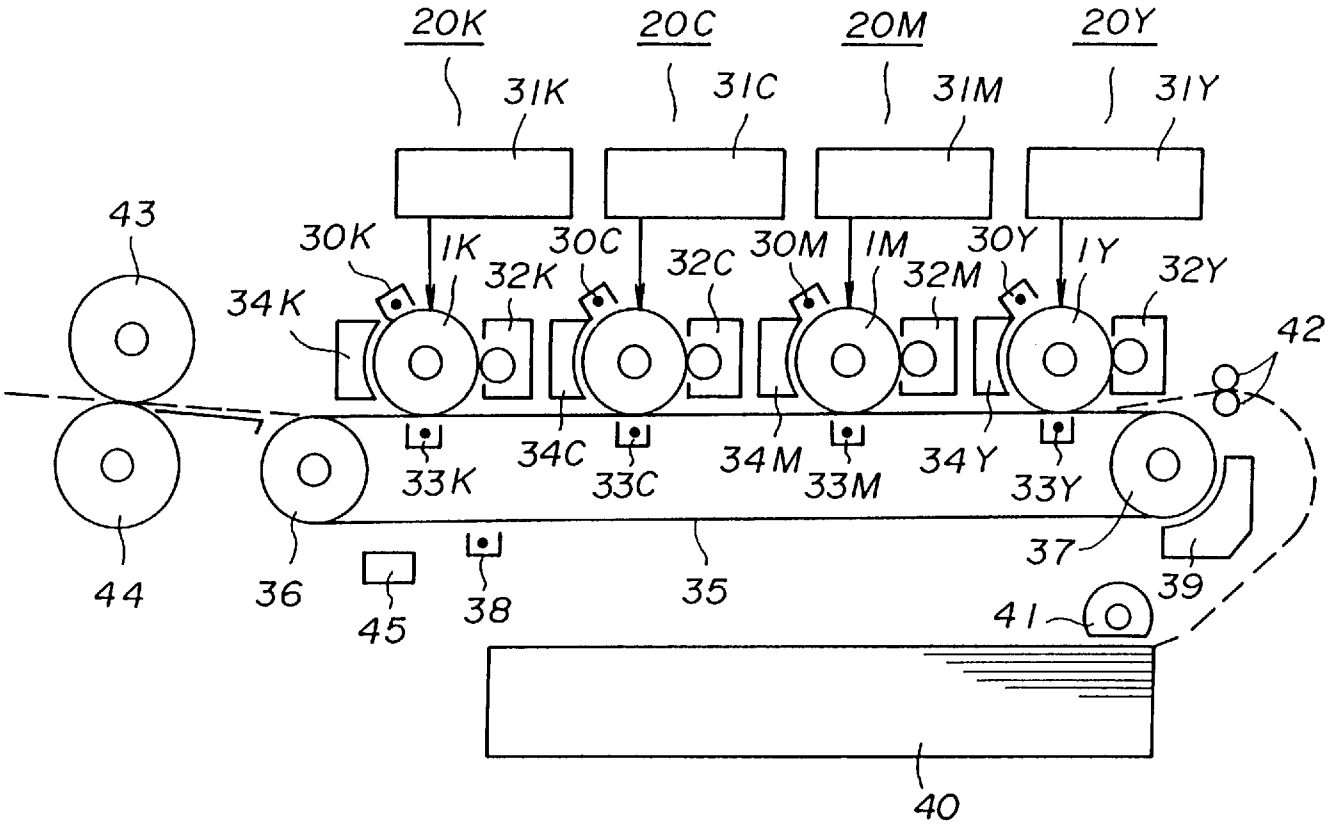
FIG. 1 PRIOR ART
FIG. 1 is an illustration of a structure of a conventional multi-color image forming apparatus.

A description will now be given, with reference to FIGS. 7 through 12, of a first embodiment of the present invention. In FIGS. 7 through 12, parts that are the same as the parts shown in FIG. 1 are given the same reference numerals, and descriptions thereof will be omitted.

Figure 7:
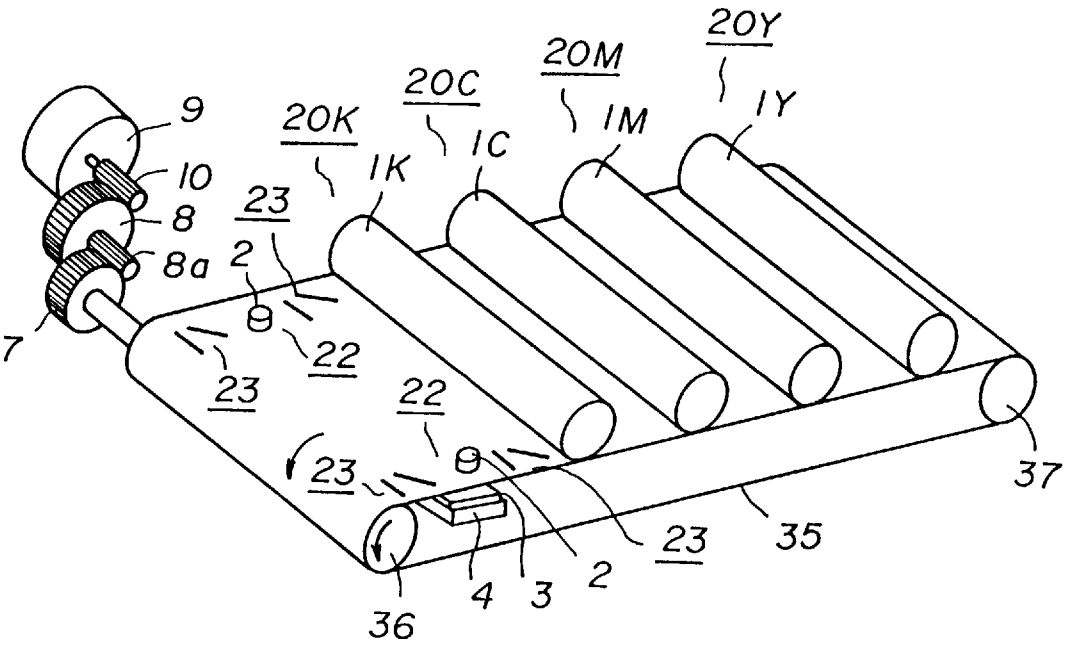
FIG. 7 is an illustration of a part of an image forming apparatus according to a first embodiment of the present invention.

FIG. 7 is an illustration of a part of an image forming apparatus according to the first embodiment of the present invention. In FIG. 7, a drive roller 36 is driven by a motor 9 via a drive roller gear 7, a gear 8*a*, an intermediate gear 8 and a motor gear 10. The motor gear 10 is formed on a rotatable shaft of the motor 10. The gear 8 engages the motor gear 10, and the gear 8*a* is formed on a rotatable shaft of the gear 8. The gear 8*a* engages the drive roller gear 7. In this drive roller driving mechanism, each of the motor 9, the motor gear 10, the intermediate gear 8 and the gear 8*a* rotate a multiple of an integer of turns while the drive roller 36, that is, the drive roller gear 7 is rotated a complete single turn.

Position offset sensors 22 are provided along opposite sides of the conveying belt 35. Each of the position offset sensor 22 comprises a light source such as a light-emitting diode 2, a slit plate 3 and a light-receiving element 4. In each of the position offset sensor 22, as shown in FIG. 7A, the light source 2 is located on an outer side of a loop of the conveying belt 35 and the slit plate 3 and the light-receiving element 4 are located on an inner side of the loop of the conveying belt 35 so that the light source 2 is aligned with the slit plate 3 and the light-receiving element 4 via the conveying belt 35. Accordingly, the light source 2 is located on a side of a surface of the conveying belt 35 on which surface the register mark 23 is transferred.

The slit plate 3 has an opening 11 having a shape the same as that of the register mark 23 formed by each of the image forming units 20Y, 20M, 20C and 20K. The opening 11 comprises, as shown in FIG. 8, a slit 11*a* extending in a direction perpendicular to a moving direction of the conveying belt 35 and a slit 11*b* extending in a direction inclined a predetermined angle with respect to the slit 11*a*.

Figure 8A:
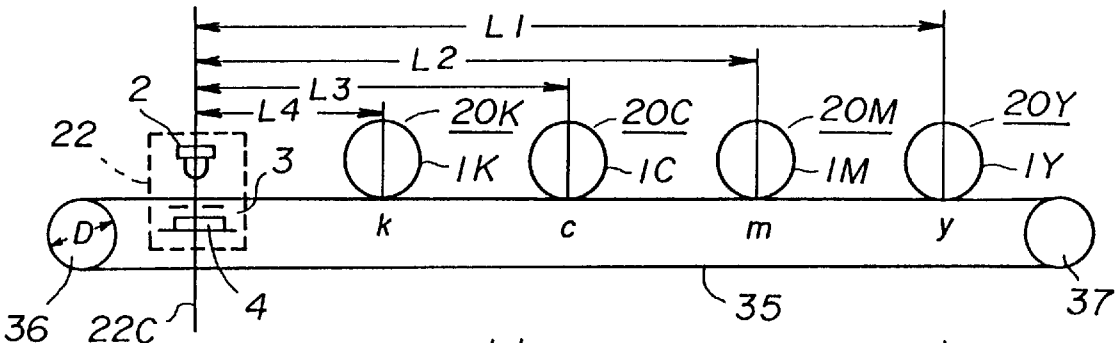
FIG. 8A is an illustration of a part of the image forming apparatus shown in FIG. 7.

Referring to FIG. 8A, in the present embodiment, the position offset sensor 22 detects the register mark 23 formed on the conveying belt 35 by the image forming units 20Y, 20M, 20C and 20K at a position where an optical axis 22*c* intersects with the conveying belt 35. Additionally, each of the image forming units 20Y, 20M, 20C and 20K transfers the register mark 23 on the conveying belt 35 at positions y, m, c, and k, respectively, as shown in FIG. 8A. Distances L1, L2, L3 and L4, which are distances from the optical axis 22*c* of the position offset sensor 22 to the respective positions y, m, c and k, are set to a multiple of an integer of the circumference Dπ of the drive roller 36. More specifically, in the example of FIG. 8A, the distance L4 is set to be equal to the circumference Dπ of the drive roller 36; the distance L3 is set to be a double of the circumference Dπ of the drive roller 36; the distance L2 is set to be three times the circumference Dπ of the drive roller 36; the distance L1 is set to be four times the circumference Dπ of the drive roller 36.

Figure 8B:
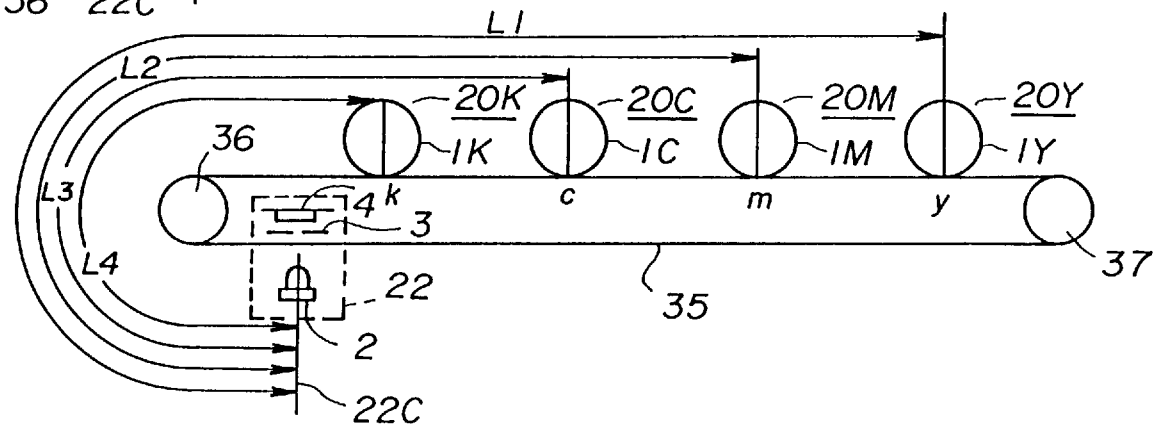
FIG. 8B is an illustration for explaining a variation of the structure shown in FIG. 8A.

FIG. 8B is an illustration for explaining a variation of the structure shown in FIG. 8A. In FIG. 8B, the position offset sensor 22 is located on the opposite side of the image forming units 20Y, 20M, 20C and 20K with respect to the conveying belt 35. The distance L4 is set to be a multiple of an integer of the circumference Dπ of the drive roller 36. The distance L3 is set to be double the circumference Dπ of the drive roller 36; the distance L2 is set to be three times the circumference Dπ of the drive roller 36; the distance L1 is set to be four times the circumference Dπ of the drive roller 36.

A description will now be given of an operation for detecting a color offset in the present embodiment.

If an eccentricity is present between the circumferential surface of the drive roller 36 and the rotational axis of the drive roller 36, a circumferential speed of a position of the drive roller 36 periodically fluctuates. This causes a periodic fluctuation in the speed of movement of the conveying belt 35 which is driven by the drive roller 36.

FIG. 10A is a time chart for showing the periodic fluctuation of the speed of movement of the conveying belt 35 due to an eccentricity in the drive roller 36. The periodic fluctuation in the speed has a period T0, and has an amplitude A with respect to a target speed V0 of the conveying roller 35. Accordingly, the speed V of the conveying belt 35 is represented by the following relationship, where ω is an angular velocity of the drive roller 36.

$$V = A \sin(\omega t) \tag{5}$$

A position offset ΔS from a target position is generated in a position of the conveying belt 35 due to the periodic fluctuation in the speed of movement of the conveying belt 35. This fluctuation causes a color offset of a multi-color image which is formed by transferring and superimposing component toner images. The position offset ΔS is calculated by integrating the moving speed V with respect to time t as follows.

$$\Delta S = \int_0^t A\sin(\omega t)dt = -(A/\omega)\cos\omega t \tag{6}$$

The position offset ΔS is as shown in FIG. 10B. In FIG. 10B, when the position offset ΔS is a positive value, this means that the actual position advances the target position. On the other hand, when the position offset ΔS is a negative value, this means that the actual position follows the target position.

For example, if a transfer of the register mark is performed at a point P1, the fluctuation in the speed V is zero at a time tp1 when the transfer is performed, but the transfer is performed in a state where the conveying belt 35 advances from the target position by A/ω. Thus, the register mark is formed at a position following the target position. When a register mark formed on the conveying belt 35 is detected at a point P2 having a phase the same with the point P1 on the downstream side of the point P1, the register mark is detected by the position offset sensor 22 by a time corresponding to the distance A/ω before a target time tp2 is reached.

Accordingly, if the register mark is transferred at the point P1 and then the register mark is detected at the point P2, a rearward offset of a transfer position of the register mark is compensated by an advance in the time of detection of the register mark. That is, when two points having the same phase are selected and a transfer of a register mark is performed at one of the two points and a detection of the register mark is performed at the other of the two points, a rearward offset of a position of the register mark is compensated by an advance in a time of detection of the register mark. Accordingly, an accurate detection of a register mark can be achieved without an influence from the periodic fluctuation in the moving speed of the conveying belt 36.

On the other hand, if a transfer of a register mark is performed at a point Q1, the fluctuation in the moving speed V is zero at a time tq1 when the transfer is performed, but the transfer is performed in a state where the conveying belt 35 follows the target position by A/ω. Thus, the register mark is formed at a position in advance of the target position. When the register mark formed on the conveying belt 35 is detected at a point Q2 having a phase the same with the point P1 on the downstream side of the point Q1, the register mark is detected by the position offset sensor 22 by a time corresponding to the distance A/ω after a target time tq2 is reached.

Accordingly, if the register mark is transferred at the point Q1 and then the register mark is detected at the point Q2, a forward offset of a transfer position of the register mark is compensated by a delay in the time of detection of the register mark. That is, when two points having the same phase are selected and a transfer of a register mark is performed at one of the two points and a detection of the register mark is performed at the other of the two points, a forward offset of a position of the register mark is compensated by a delay in the time of detection of the register mark. Accordingly, an accurate detection of a register mark can be achieved without an influence from the periodic fluctuation in the moving speed of the conveying belt 36.

In the present embodiment, since the distances L1, L2, L3 and L4, which are distances from the optical axis 22*c* of the position offset sensor 22 to the respective transfer positions y, m, c and k, are set to a multiple of an integer of the circumference Dπ of the drive roller 36, a phase of the position offset ΔS of each of the transfer positions y, m, c and k is the same with the phase of the position offset ΔS of the position at which the register mark 23 is detected. Accordingly, an amount of color offset can be accurately detected without influence of the periodic fluctuation in the speed of movement of the conveying belt 36 so as to perform an appropriate correction of the color offset.

Figure 11:
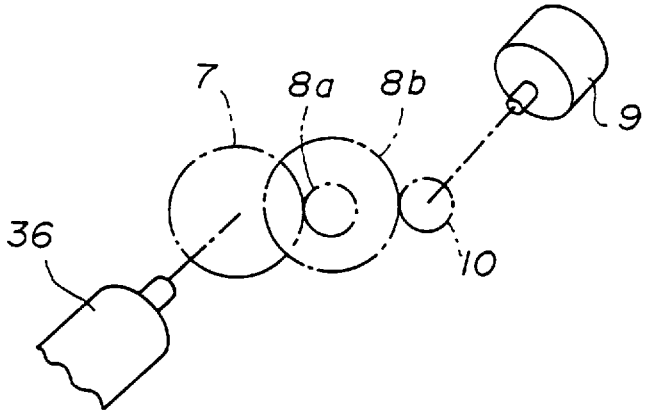
FIG. 11 is an illustration for explaining a structure of a rotational force transmitting mechanism.
Figure 12:
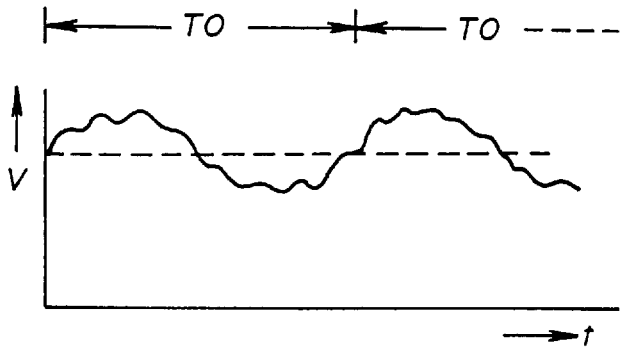
FIG. 12 is an illustration for explaining a fluctuation in a moving speed of the conveying belt caused by the rotational force transmitting mechanism.

Additionally, since a rotational force of the motor 9 is transmitted to the drive roller 36 via a rotational force transmitting mechanism including the motor gear 10, the intermediate gear 8, the gear 8*a* and the drive roller gear 7 as shown in FIG. 11, fluctuations having a period smaller than the period of the periodic fluctuation are generated in the moving speed V of the conveying belt 35 as shown in FIG. 12. The fluctuations are generated due to the tolerances in the dimensions of each gear such as eccentricity of a pitch circle. However, in the present invention, since the motor 9, the motor gear 10, the intermediate gear 8 and the gear 8*a* are arranged to rotate a multiple of an integer of turns while the drive roller 36 rotates a single turn, a plurality of sets of the fluctuations having a smaller period are included in the single period of the periodic fluctuation of the moving speed V. Accordingly, each cycle of the moving speed V has the same fluctuation curve. Thus, the color offset can be accurately detected without influence of the fluctuations due to the rotational force transmitting mechanism so as to perform an appropriate correction of the color offset.

As mentioned above, according to the present embodiment, an accurate detection of the color offset can be performed without influences of the periodic fluctuation in the speed of movement of the conveying belt 35 and an influence of fluctuations due to the rotational force transmitting mechanism. Since the opening 11 of the slit plate 3 comprises the slit 11*a* and the slit 11*b* which is inclined with respect to the slit 11*a*, color detection can be performed in both the moving direction of the conveying belt 35 and the direction perpendicular to the moving direction.

Figure 13:
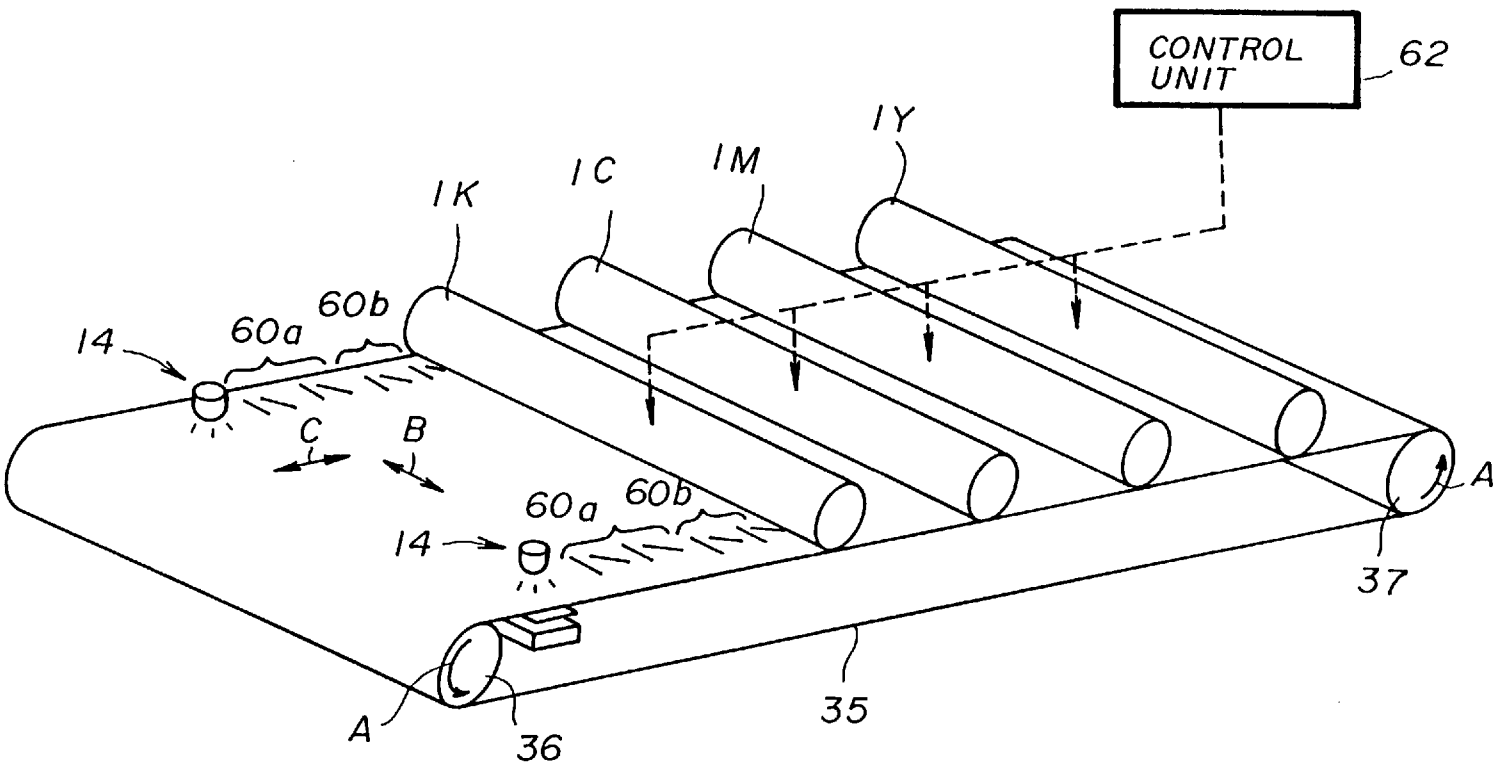
FIG. 13 is a perspective view of a part of an image forming apparatus according to a second embodiment of the present invention.

A description will now be given of a second embodiment of the present invention. FIG. 13 is a perspective view of a part of an image forming apparatus according to the second embodiment of the present invention. In FIG. 13, parts that are the same as the parts shown in FIG. 2 are given the same reference numerals, and descriptions thereof will be omitted.

Figure 3A:
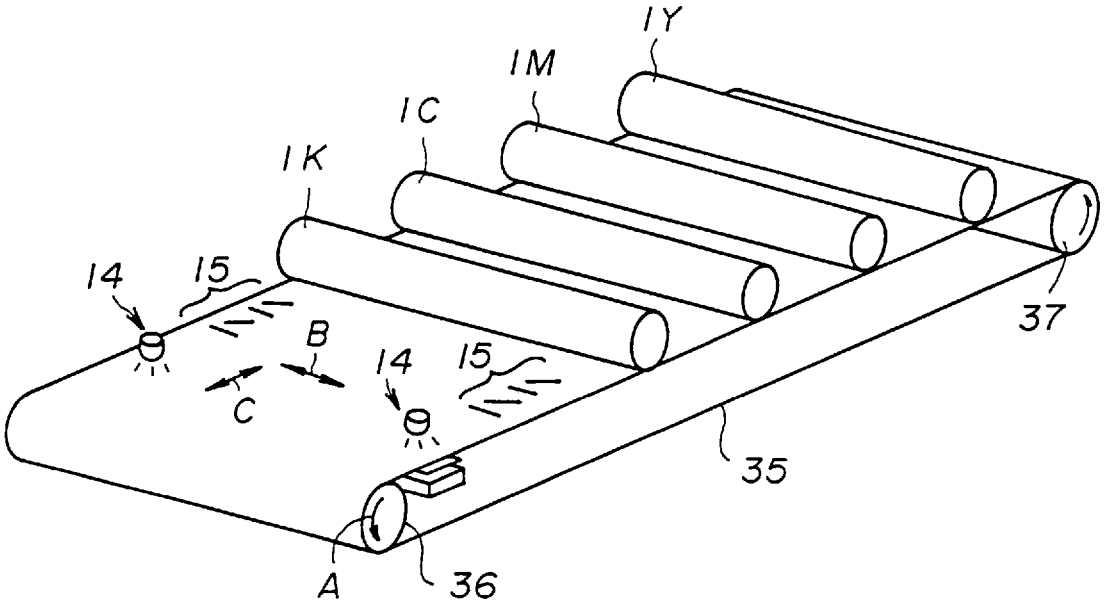
FIG. 3A PRIOR ART
FIG. 3A is a perspective view of a part of the image forming apparatus shown in FIG. 2.
Figure 3B:
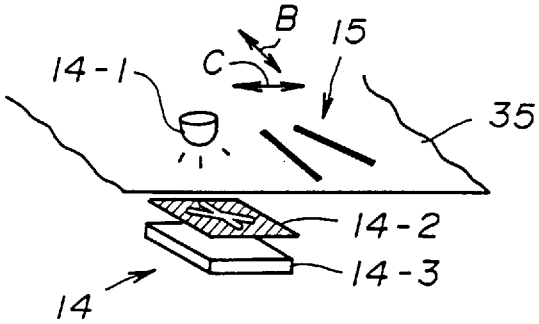
FIG. 3B PRIOR ART
FIG. 3B is a perspective view of a register mark detecting sensor shown in FIG. 3A.

In FIG. 13, two pairs 60*a* and 60*b* of register marks are formed on the conveying belt 35 by two of the image forming units. Each of the first pair 60*a* of the register marks the second pair 60*b* of the register marks comprises the same color marks having the same configuration. The second pair 60*b* of the register marks are apart away from the first pair 60*a* of the register marks by a distance corresponding to one half of the circumference of the drive roller 36 which drives the conveying belt 35. It should be noted that the structure of the register mark detecting sensor 14 is the same as that shown in FIG. 3B.

Figure 2:
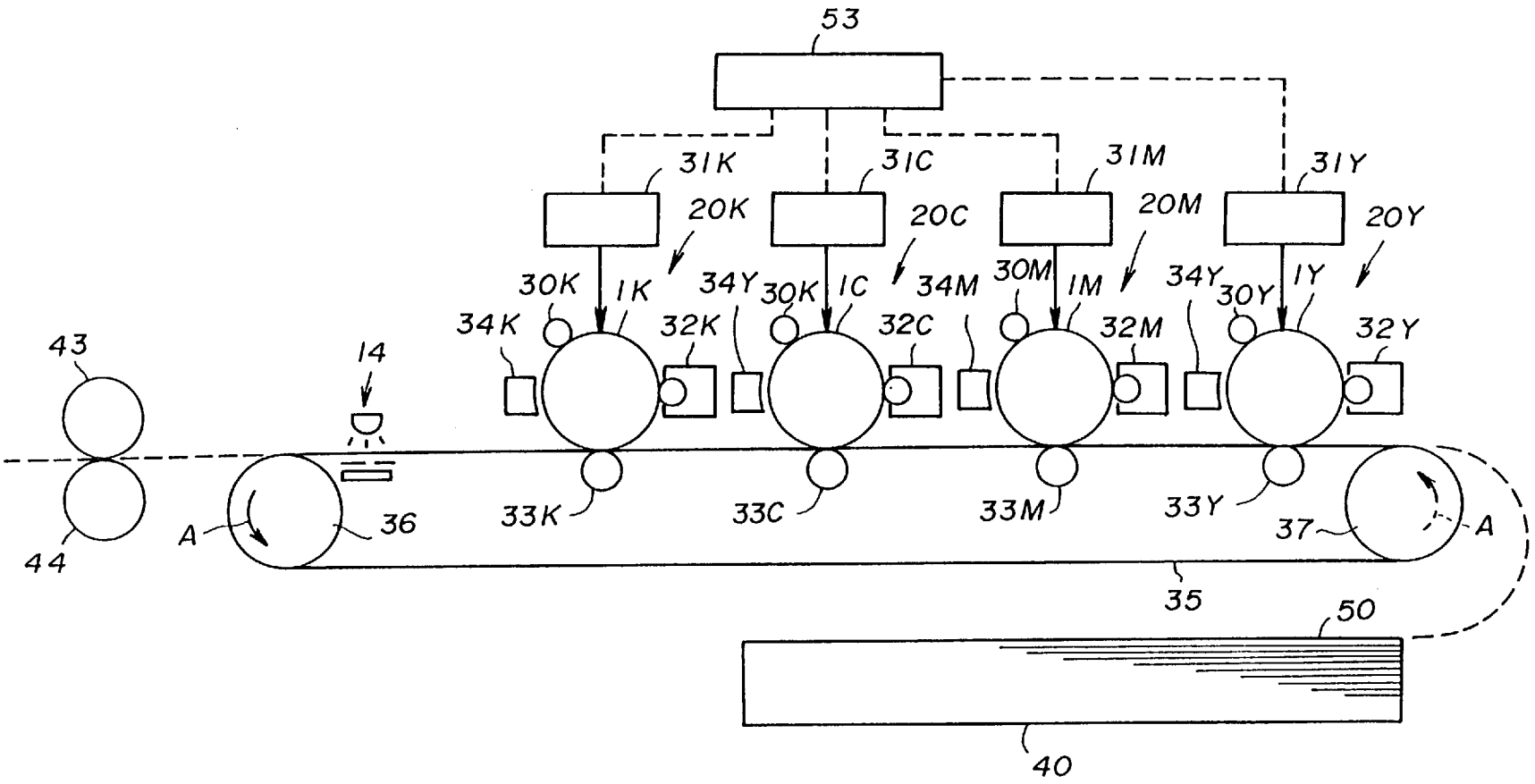
FIG. 2 PRIOR ART
FIG. 2 is an illustration of a structure of another conventional multi-color image forming apparatus.

Timing of the formation of the pairs 60*a* and 60*b* of the register marks is controlled by a control unit 62 in a similar manner to the control unit 53 shown in FIG. 2.

Figures 14A, 14B:
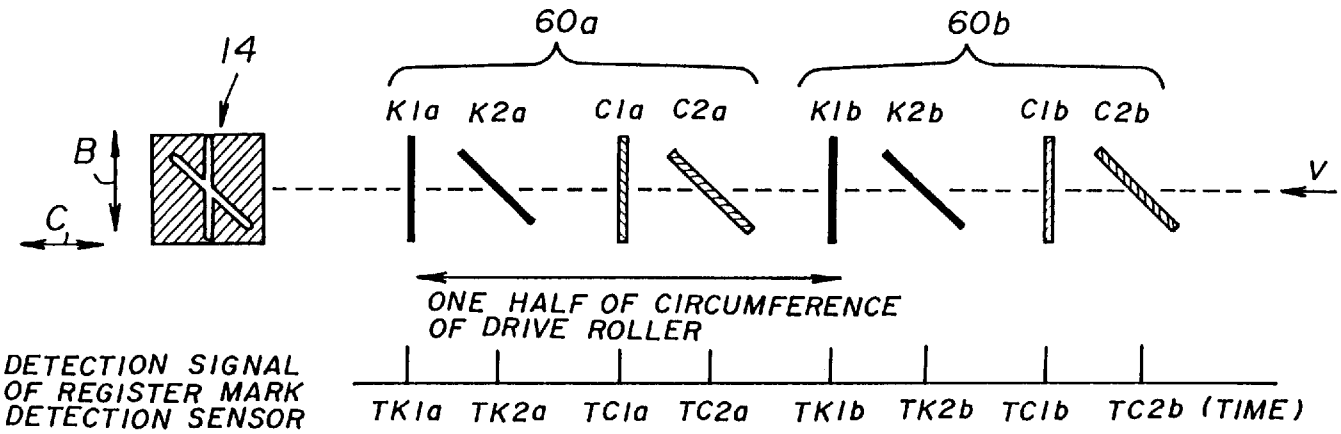
FIG. 14A is an illustration showing an example of a positional relationship between the register mark detecting sensor and pairs of register marks.
FIG. 14B is a time chart of a detection signal of the register mark detecting sensor when the register marks shown in FIG. 14A are detected.
Figure 15:
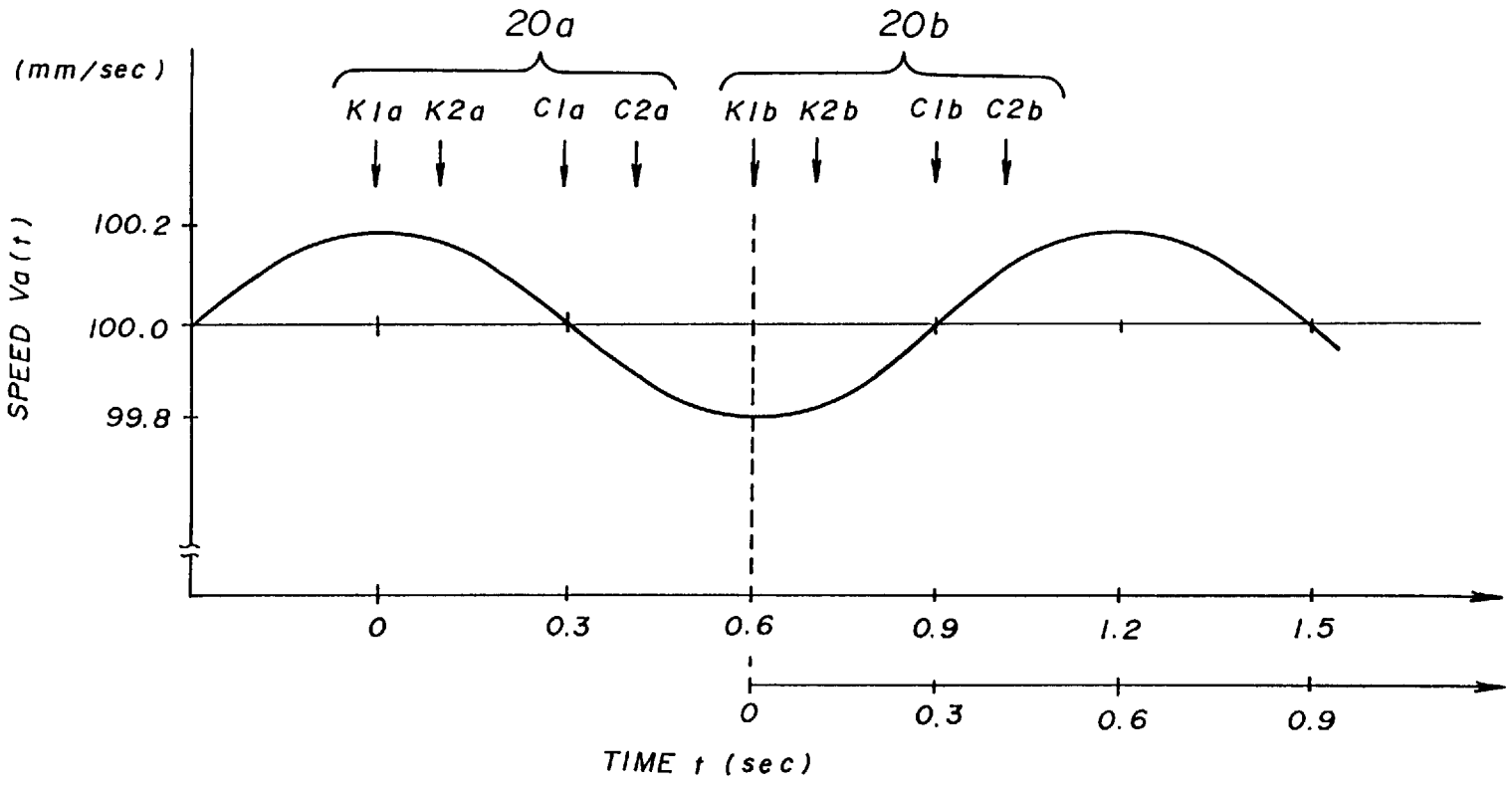
FIG. 15 is a graph showing a fluctuation in a moving speed of the conveying belt.

FIG. 14A is an illustration showing an example of a positional relationship between the register mark detecting sensor 14 and the pairs of the register marks 60*a* and 60*b*. In this example, the pair 60*a* of the register marks comprises black register marks K1*a* and K2*a* and cyan register marks C1*a* and C2*a*; and the pair 60*b* of the register marks comprises black register marks K1*b* and K2*b* and cyan register marks C1*b* and C2*b*. The pair 60*b* of the register marks is spaced from the pair 60*a* of the register marks by a distance equal to one half of the circumference of the drive roller 36. FIG. 14B is a time chart of a detection signal of the register mark detecting sensor 14 when the register marks shown in FIG. 14A are detected. FIG. 14B shows that the marks K1*a*, K2*a*, C1*a* and C2*a* of the first pair 60*a* of the register marks are detected at time TK1*a*, TK2*a*, TC1*a* and TC2*a*; and the register marks K1*b*, K2*b*, C1*b* and C2*b* of the second pair 60*b* of the register marks are detected at time TK1b, TK2b, TC1b and TC2b. FIG. 15 shows a fluctuation in a speed of movement of the conveying belt 35. In FIG. 15, the time of detection of the register marks shown in FIG. 14B is indicated. That is, in FIG. 15, the marks K1*a*, K2*a*, C1*a*, C2*a*, K1*b*, K2*b*, C1*b* and C2*b* of the pairs 60*a* and 60*b* of the register marks are detected at positions indicated by downward arrows.

With regard to the first pair 60*a* of the register marks, it is assumed that the first black mark K1*a* is set as a reference mark and a time t when the black mark K1*a* is detected is zero (t=0). A speed Va(t) of the conveying belt 35 is represented by the following relationship.

$$Va(t)=V0+V1\times\cos(\omega t) \tag{7}$$

A distance La(t) of travel of the conveying belt 35 passing the register mark detecting sensor 14 is represented by the following relationship.

$$La(t)=V0\times t+(V1/\omega)\times\sin(\omega t) \tag{8}$$

Additionally, the time when the register mark is spaced from the reference mark (black mark K1*a*) by a distance Lx corresponds to the time which satisfies the following relationship.

$$La(t)=L\times \quad (9)$$

With regard to the second pair 60*b* of the register marks, it is assumed that the first black mark K1*b* is set as a reference mark and a time t when the black mark K1*b* is detected is zero (t=0). A speed Vb(t) of the conveying belt 35 is represented by the following relationship.

$$Vb(t)=V0-V1\times\cos(\omega t) \quad (10)$$

A distance Lb(t) of travel of the conveying belt 35 passing the register mark detecting sensor 14 is represented by the following relationship.

$$Lb(t)=V0\times t-(V1/\omega)\times\sin(\omega t) \quad (11)$$

Additionally, the time when the register mark is spaced from the reference mark (black mark K1*b*) by a distance Lx corresponds to the time which satisfies the following relationship.

$$Lb(t)=L\times \quad (12)$$

Each of the pairs 60*a* and 60*b* of the register marks comprises a pair of marks having the same color and the same configuration. Thus, the distances of the register marks to be detected from the reference marks (in this case, black marks K1*a* and K1*b*) are the same. That is, the distance between marks K1*a* and K2*a* is equal to the distance between marks K1*b* and K2*b*; the distance between marks K1*a* and C1*a* is equal to the distance between marks K1*b* and C1*b*; and the distance between marks K1*a* and C2*a* is equal to the distance between marks K1*b* and C2*b*. Accordingly, with respect to the corresponding marks, values of Lx in the relationships (9) and (12) should be equal to each other. Thus, the following relationship is obtained from the relationships (9) and (12).

$$La(t) + Lb(t) = 2 \cdot Lx \quad (13)$$
$$V0xt = Lx$$
$$t = Lx/V0$$

The obtained time t is based on the assumption that the conveying belt 35 moves at the constant speed V0 and the time of detection does not have an error due to a fluctuation in the speed of movement of the conveying belt 35. As a result, an accurate detection of a position offset can be performed without influence of a periodic fluctuation in the speed of movement of the conveying belt 35 by averaging the results of detections for the pairs 60*a* and 60*b* of the register marks.

A description will now be given of a specific example of the image forming apparatus according to the present embodiment.

(Specific Example 1)

Figure 4A:
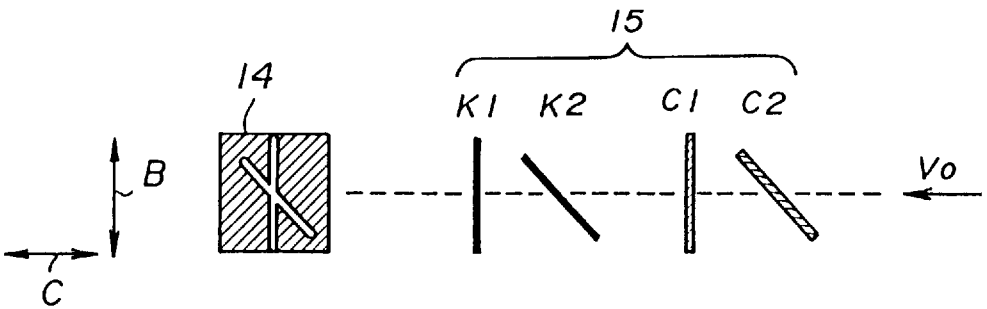
FIG. 4A PRIOR ART
FIG. 4A is an illustration for explaining a relationship between the register mark detecting sensor and register mark.

Similar to the example shown in FIG. 4A, it is assumed that the pairs 60*a* and 60*b* of the register marks have a positional relationship as follows:

a distance between marks K1*a* and K2*a* is 10 mm;

a distance between marks K1*a* and C1*a* is 30 mm;

a distance between marks K1*a* and C2*a* is 40 mm;

a distance between marks K1*b* and K2*b* is 10 mm;

a distance between marks K1*b* and C1*b* is 30 mm; and a distance between marks K1*b* and C2*b* is 40 mm.

In this case, for example, a result of detection for the set 60*a* of the register mark pairs may be TK1*a*=0 sec; TK2*a*=0.09981 sec; TC1*a*=0.29962 sec; TC2*a*=0.39967 sec. In this condition, an amount Ea of position offset in the primary scanning direction and an amount Fa of position offset in the secondary scanning direction can be calculated as follows.

$$Ea=0.024\ \text{mm}=24\ \mu\text{m}$$

$$Fa=-0.038\ \text{mm}=-38\ \mu\text{m}$$

On the other hand, for example, a result of detection for the set 60*a* of the register mark pairs may be TK1*b*=0 sec; TK2*b*=0.10019 sec; TC2*b*=0.30138 sec; TC2*b*=0.40033 sec. In this condition, an amount Eb of position offset in the primary scanning direction and an amount Fb of position offset in the secondary scanning direction can be calculated as follows.

$$Eb=0.024\ \text{mm}=-24\ \mu\text{m}$$

$$Fb=-0.038\ \text{mm}=38\ \mu\text{m}$$

Accordingly, average values Eave and Fave are represented as follows.

$$Eave=(Ea+Eb)/2=0 \quad (14)$$

$$Fave=(Fa+Fb)/2=0 \quad (15)$$

Figure 4B:
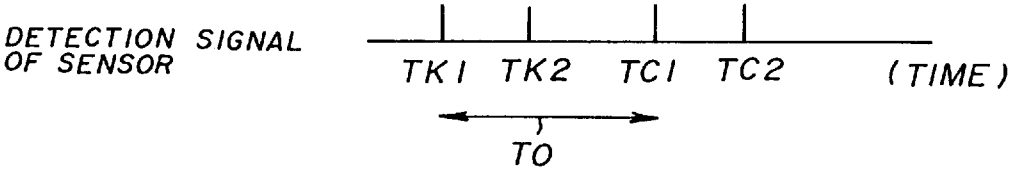
FIG. 4B PRIOR ART
FIG. 4B is a time chart of a detection signal of the register mark detecting sensor.

This result indicates that the amount of position offset coincides with that of the example shown in FIG. 4 which is obtained under the condition that there is no fluctuation in the speed of the movement of the conveying belt 35.

(Specific Example 2)

Similar to the example shown in FIG. 5A, it is assumed that the sets 60*a* and 60*b* of the register mark pairs have a positional relationship as follows:

a distance between marks K1*a* and K2*a* is 10 mm;

a distance between marks K1*a* and C1*a* is 30.1 mm;

a distance between marks K1*a* and C2*a* is 40.15 mm;

a distance between marks K1*b* and K2*b* is 10 mm;

a distance between marks K1*b* and C1*b* is 30.1 mm; and a distance between marks K1*b* and C2*b* is 40.15 mm.

In this case, for example, a result of detection for the pair 60*a* of the register marks may be TK1*a*=0 sec; TK2*a*=0.09981 sec; TC1*a*=0.29962 sec; TC2*a*=0.40117 sec. In this condition, an amount Ea of position offset in the primary scanning direction and an amount Fa of position offset in the secondary scanning direction can be calculated as follows.

$$Ea=0.074\ \text{mm}=74\ \mu\text{m}$$

$$Fa=-0.062\ \text{mm}=-62\ \mu\text{m}$$

On the other hand, for example, a result of detection for the pair 60*a* of the register marks may be TK1*b*=0 sec; TK2*b*=0.10019 sec; TC2*b*=0.30138 sec; TC2*b*=0.43183 sec. In this condition, an amount Eb of position offset in the primary scanning direction and an amount Fb of position offset in the secondary scanning direction is calculated as follows.

$$Eb=0.026\ \text{mm}=-26\ \mu\text{m}$$

$$Fb=-0.138\ \text{mm}=138\ \mu\text{m}$$

Accordingly, average values Eave and Fave are represented as follows.

$$Eave=(Ea+Eb)/2=50\ \mu\text{m}$$

$$Fave=(Fa+Fb)/2=100\ \mu\text{m}$$

Figure 5A:
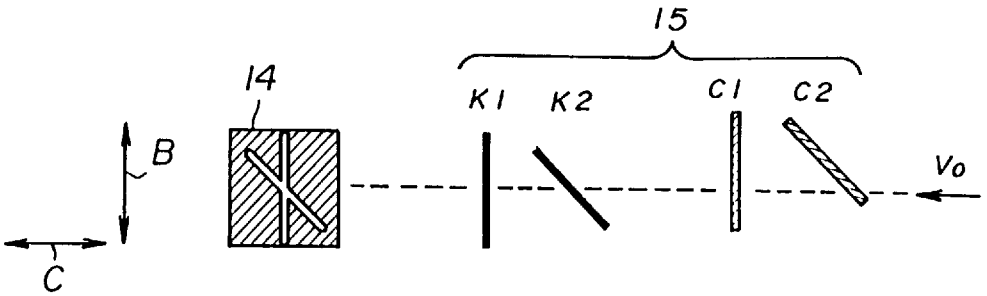
FIG. 5A PRIOR ART
FIG. 5A is an illustration for explaining a relationship between the register mark detecting sensor and register mark when the register mark has a position offset.
Figure 5B:
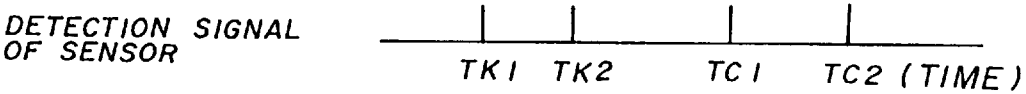
FIG. 5B PRIOR ART
FIG. 5B is a time chart of a detection signal of the register mark detecting sensor when the register mark shown in FIG. 5A is detected.
Figure 6:
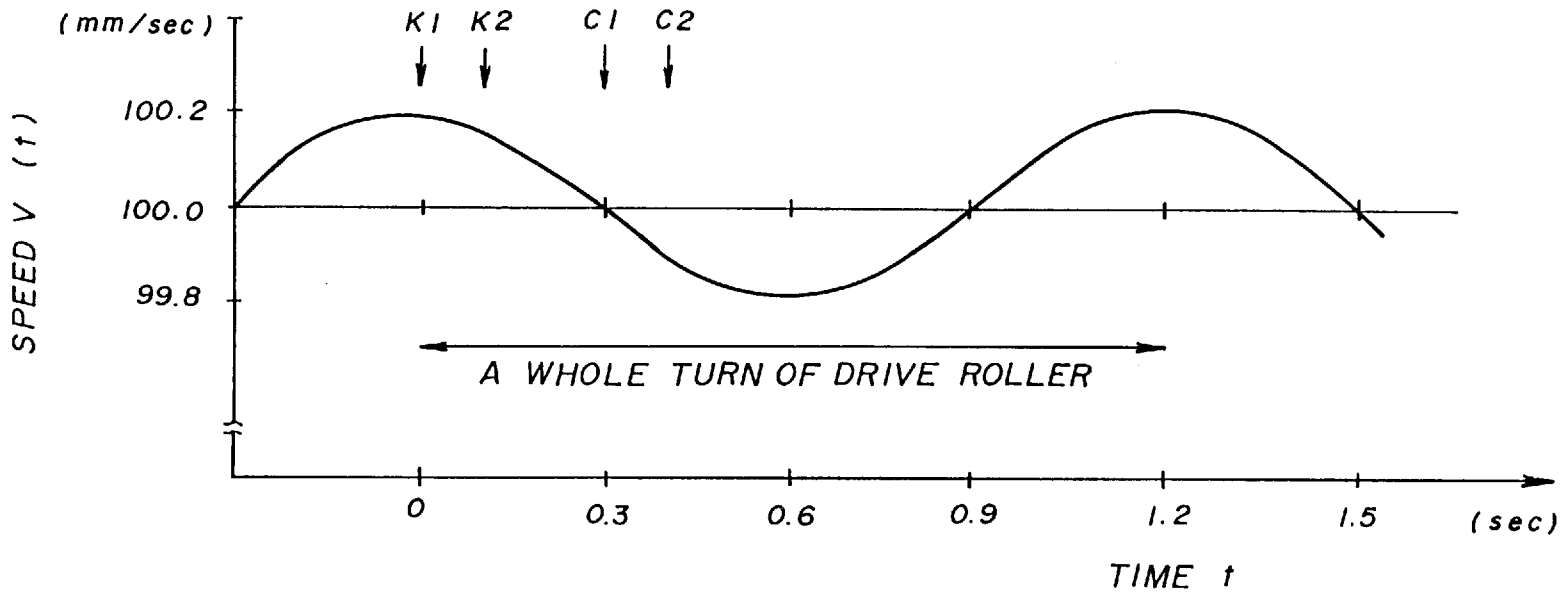
FIG. 6 PRIOR ART
FIG. 6 is a graph showing a periodic fluctuation generated in a speed of a conveying belt.

This result indicates that the amount of position offset coincides with the amount of offset of position of the example shown in FIG. 5A which is obtained under the condition that where is no fluctuation in the moving speed of the conveying belt.

As mentioned above, an accurate amount of offset of register mark position can be obtained even when there is a periodic fluctuation in the speed of movement of the conveying belt 35 by averaging the results of detection for the pairs of register marks, each pair being formed spaced apart from each other by a distance corresponding to one half of the circumference of the drive roller 36 which drives the conveying belt 35.

It should be noted that although the black register mark and the cyan register mark are used in the above-mentioned second embodiment, the present invention is not limited to these colors and shapes of the register mark and an accurate amount of position offset can be obtained by other combinations of colors or other shapes of the register mark. It is necessary to obtain an accurate amount of position offset so as to perform an accurate registration of color component images. Thus, a high quality color image can be obtained by an accurate registration based on the present invention.

Figure 16A:
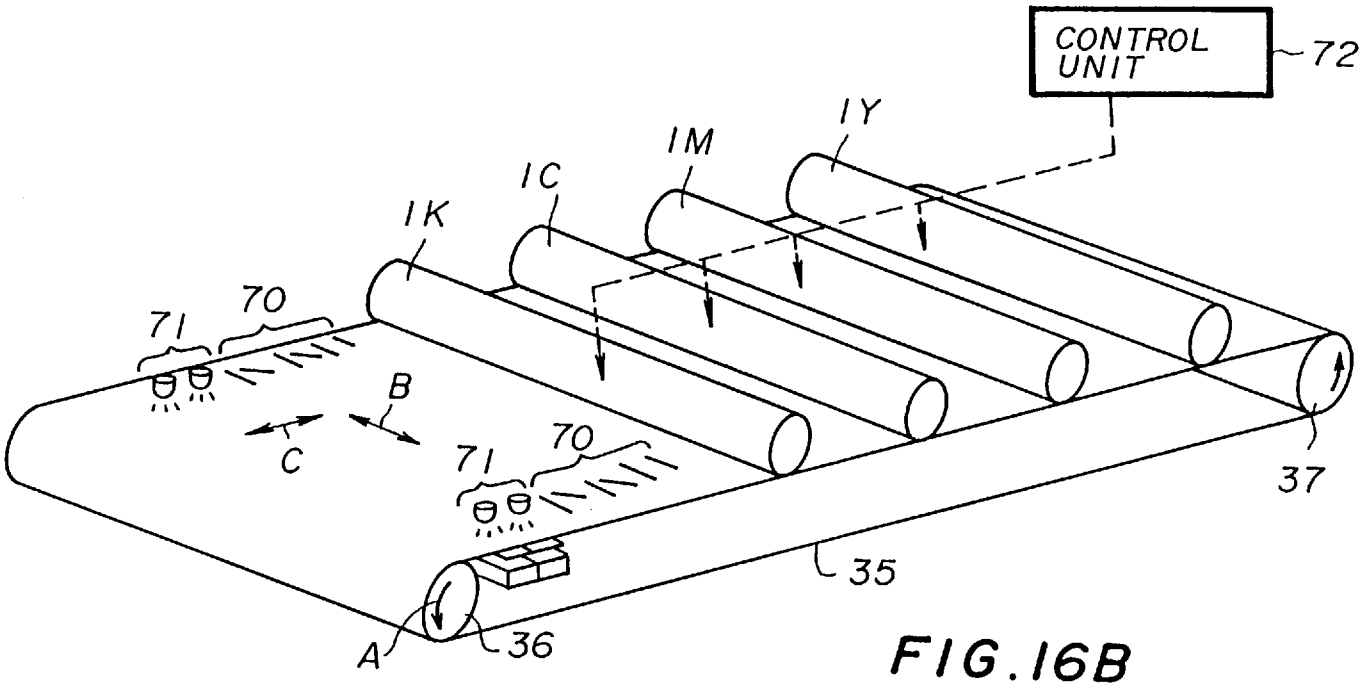
FIG. 16A is a perspective view of a color image forming apparatus according to a third embodiment of the present invention.
Figure 16B:
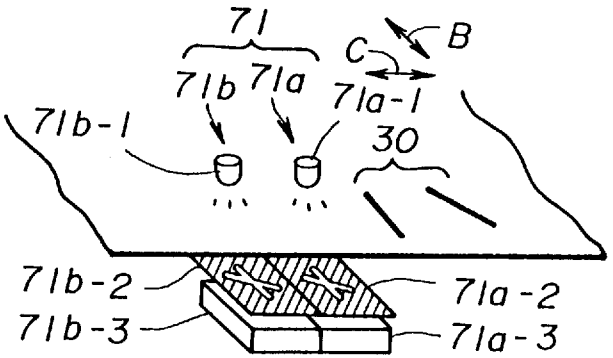
FIG. 16B is an enlarged perspective view of a pair of register mark detecting sensors shown in FIG. 16A.

A description will now be given of a third embodiment of the present invention. FIG. 16A is a perspective view of a color image forming apparatus according to a third embodiment of the present invention. FIG. 16B is an enlarged perspective view of a pair of register mark detecting sensors shown in FIG. 16A. In FIG. 16A, parts that are the same as the parts shown in FIG. 2 are given the same reference numerals, and descriptions thereof will be omitted.

In FIG. 16A, a plurality of register marks 70 are formed on the conveying belt 35. Additionally, the register marks 70 are detected by a resister mark detecting sensor unit 71 which comprises a pair of register mark detecting sensors 71*a* and 71*b*. In the present embodiment, the pair of register mark detecting sensors 71 is provided on each side of the conveying belt 35.

Specifically, as shown in FIGS. 16A and 16B, the register mark detecting sensors 71*a* and 71*b* are arranged along the moving direction (indicated by an arrow C) of the conveying belt 35. The register mark detecting sensors 71*a* comprises a light-emitting diode (LED) 71*a*-1, a slit plate 71*a*-2 and a light-receiving element 71*a*-3. The LED 71*a*-1 is located on the side of the conveying belt 35 where the register marks 70 are formed so as to project a light to the register marks 70. The slit plate 71*a*-2 and the light-receiving element 71*a*-3 are located on the opposite side of the conveying belt 35, that is, an inner side of a loop formed by the conveying belt 35. The slit plate 71*a*-2 has a slit having a shape the same as that of the register mark 70 so that the a light projected from the LED 71*a*-1 passes therethrough. The light-receiving element 71*a*-3 receives the light passing through the slit of the slit plate 71*a*-2. Accordingly, the light-receiving element 71*a*-3 receives the light projected from the LED 71*a*-1 when the register mark 70 is not present. On the other hand, the light-receiving element 71*a*-3 receives a reduced light when the register mark 70 passes directly above the slit plate 71*a*-2. The light-receiving element 71*a*-3 detects the time when the register mark 70 passes by a difference in the amount of received light. Similarly, the register mark detecting sensor 71*b* comprises a light-emitting diode (LED) 71*b*-1, a slit plate 71*b*-2 and a light-receiving element 71*b*-3 which are arranged in the same manner as that of the register mark detecting sensor 71*a*. The plurality of register marks 70 are formed at intervals equal to the distance between the register mark detecting sensors 71*a* and 71*b*.

Timing of the formation of the register marks 70 is controlled by a control unit 62 in a similar manner to the control unit 53 shown in FIG. 2.

Figures 17A, 17B:
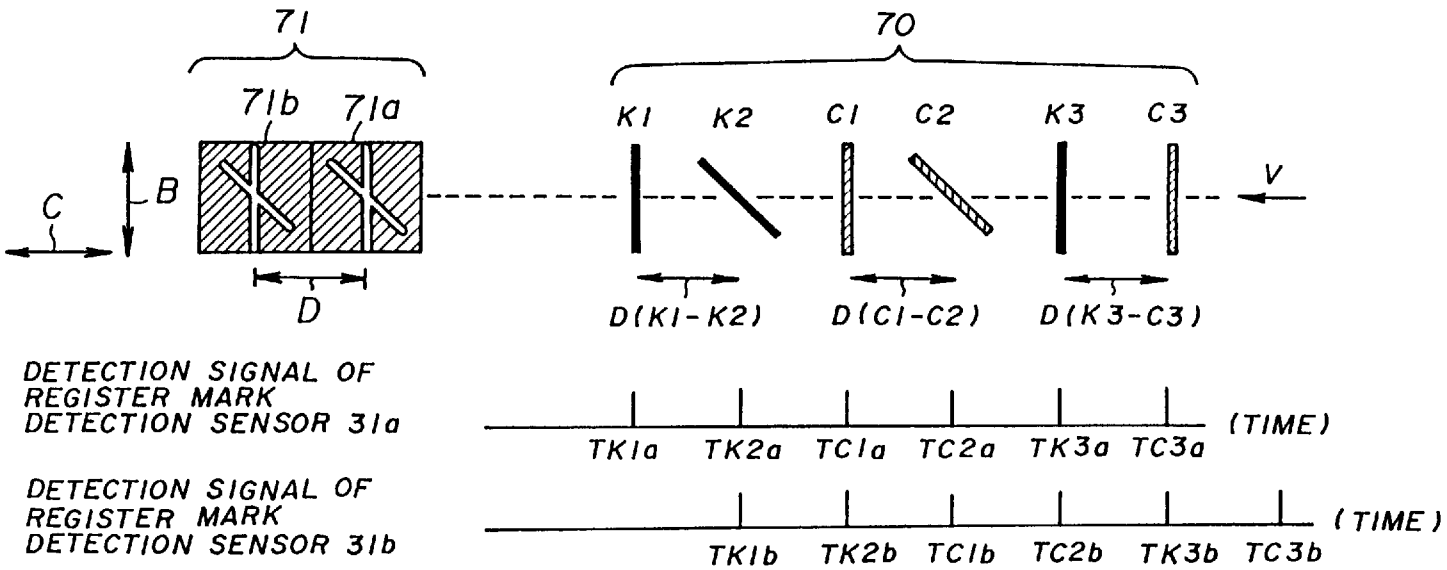
FIG. 17A is an illustration for explaining a positional relationship between a register mark detecting unit and a plurality of register marks shown in FIG. 16A.
FIG. 17B is a time chart of detection signals of the register mark detection sensors when the register marks shown in FIG. 17A are detected.

FIG. 17A is an illustration for explaining a positional relationship between the register mark detecting unit 71 and the plurality of register marks 70. It is assumed that the register mark detecting sensors 71*a* and 71*b* are spaced apart from each other by a distance D; the marks K1 and K2 are spaced apart from each other by a distance D(K1-K2); the marks C1 and C2 are spaced apart from each other by a distance D(C1-C2); and the marks K3 and C3 are spaced apart from each other by a distance D(K3-C3). In the present embodiment, the distances D(K1-K2), D(C1-C2) and D(K3-C3) are set to be equal to the distance D. FIG. 17B is a time chart of detection signals of the register mark detection sensors 71*a* and 71*b* when the register marks 70 are detected. As shown in FIG. 17B, first the mark K1 is detected at a time TK1*a* by the register mark detecting sensor 71*a*. Thereafter, the mark K1 is detected at a time TK1*b* by the register mark detecting sensor 71*b* when the conveying belt 35 advances the distance D. Additionally, substantially at the time TK1*b*, the mark K2 is detected at a time TK2*a* by the register mark detecting sensor 71*a*. Thereafter, in the same manner, the remainder of the marks C1, C2, K3 and C3 are detected by the register mark detecting sensors 71*a* and 71*b* as shown in FIG. 17B. In FIG. 17B, a time when each of the marks are detected by the register mark detecting sensor 71*a* is indicated as Tk1*a*, TK2*a*, TC1*a*, TC2*a*, TK3*a* and TC3*a*, and a time when each of the marks is detected by the register mark detecting sensor 71*b* is indicated as Tk1*b*, TK2*b*, TC1*b*, TC2*b*, TK3*b* and TC3*b*.

In the present embodiment, an amount of the offset in the primary scanning direction (direction B) and an amount of offset in the secondary scanning direction (direction C) is calculated based on the detection signals output by the register mark detecting sensors 71*a* and 71*b*. For example, for the register marks 70 shown in FIG. 17A, an amount of position offset of the cyan mark with respect to the reference mark (black mark in this case) can be obtained as follows. That is, an amount E of position offset in the primary scanning direction is obtained by the following relationship.

$$E=\{(TC2a-TC1b)-(TK2a-TK1b)\}\times V0 \quad (16)$$

Additionally, an amount F of position offset in the secondary scanning direction is obtained by the following relationship.

$$F=(TK3a-TK3b)\times V0 \quad (17)$$

It should be noted that the relationship (17) represents an error with respect to the distance D between the register mark detecting sensors 71*a* and 71*b*.

As appreciated from the relationships (16) and (17), the amounts F and F of the register position offset in the primary and secondary scanning directions are calculated based on time differences between the detection signals which are output at substantially the same time. Since the time difference is very small, an influence of a periodic fluctuation in the speed of movement of the conveying belt 35 is almost negligible. Thus, an error generated in the obtained position offset can be a small value.

Consideration is given to an example of a set of register marks in which D=15 mm; D(K1-K2)=15 mm; D(C1-C2)=15.05 mm; D(K3-C3)=15.1 mm. That is, the amount of offset in the primary scanning direction is D(C1-C2)−D(K1-K2)=15.05−15=0.05 mm, and the amount of offset in the secondary scanning direction is D(K3-C3)−D=15.1−15=0.1 mm.

Figure 18:
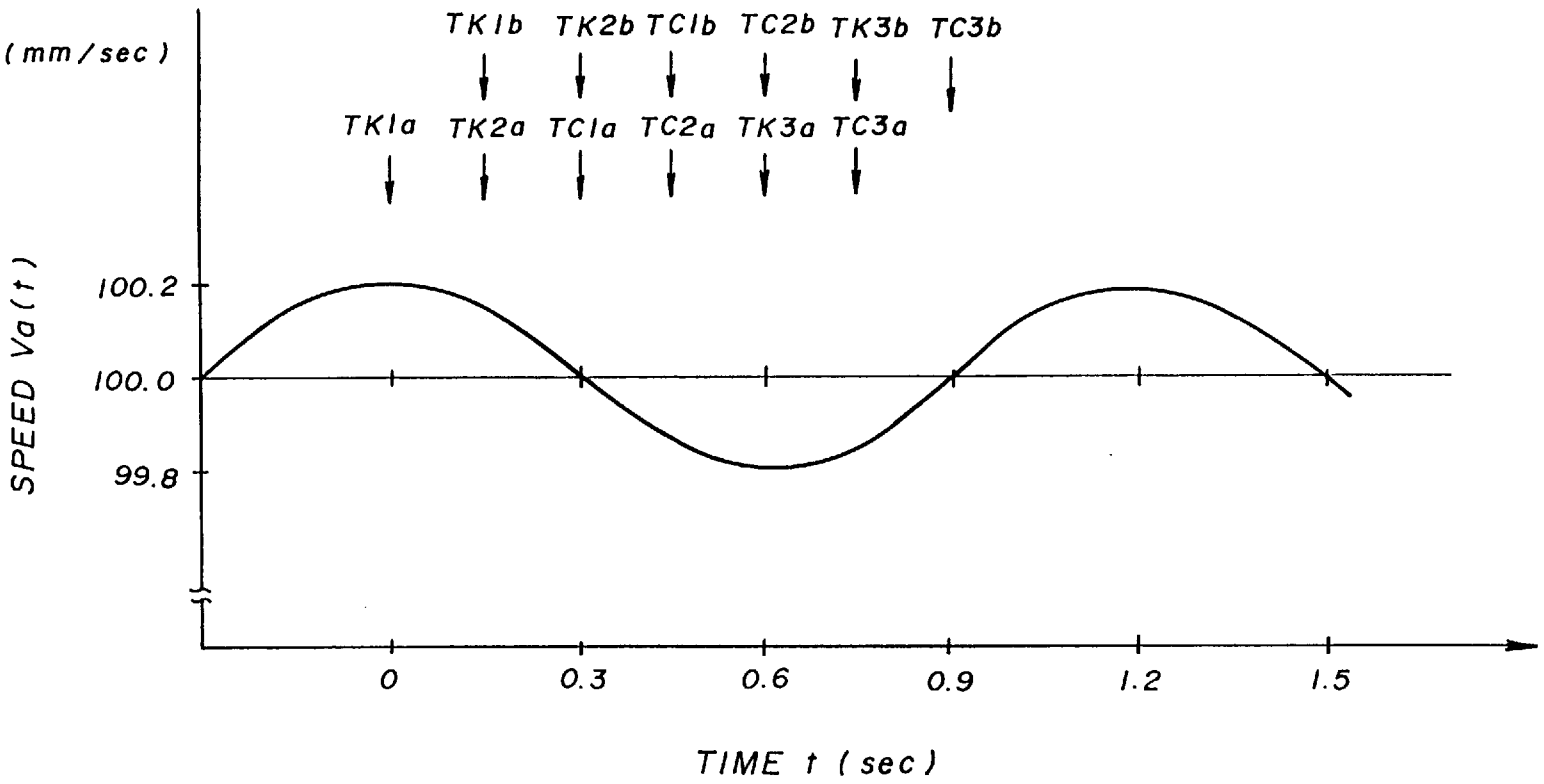
FIG. 18 is a graph showing a fluctuation in a moving speed of the conveying belt.

FIG. 18 shows a moving speed of the conveying belt 35 having a periodic fluctuation. In FIG. 18, if the time when the mark K1 is first detected by the register mark detection sensor 71*a* is set to zero (t=0; TK1*a*=0), the time when each register mark is detected can be, for example, as follows.

TK2*a*=0.14973 sec, TC2*a*=0.45123 sec

TC3*a*=0.75127 sec, TK1*b*=0.14973 sec

TC1*b*=0.45073 sec, TK3*b*=0.75027 sec

Using the relationships (16) and (17), the amount E and F of the offsets in the primary and secondary scanning directions are obtained as follows.

$$E = \{(0.45123 - 0.45073) - (0.14973 - 0.14973)\} \times 100 = 0.05 \text{ mm} = 50\ \mu\text{m}$$

$$F = (0.75127 - 0.75027) \times 100 = 0.1 \text{ mm} = 100\ \mu\text{m}$$

This results coincides with the amount of the position offset of the register marks.

As mentioned above, an accurate amount of offset of register mark position can be obtained even when there is a periodic fluctuation in the moving speed of the conveying belt 35 by arranging the pair of register mark detecting sensors 71*a* and 71*b* along a moving direction of the conveying belt 35 and detecting the register marks formed at intervals corresponding to the distance between the register mark detecting sensors 71*a* and 71*b* so as to obtain the register position offset based on the time difference between the detection signals output from the register mark detecting sensors 71*a* and 71*b*.

It should be noted that although the black register mark and the cyan register mark are used in the above-mentioned second embodiment, the present invention is not limited to these colors and shapes of the register mark and an accurate amount of position offset can be obtained by other combinations of colors or other shapes of the register mark. It is necessary to obtain an accurate amount of position offset so as to perform an accurate registration of color component images. Thus, a high quality color image can be obtained by an accurate registration based on the present invention.

The present invention is not limited to the specifically disclosed embodiments, and variations and modifications may be made without departing from the scope of the present invention.

What is claimed is:

1. An image forming apparatus for forming a multi-color image formed by transferring and superimposing a plurality of color component images on a transfer sheet, said image forming apparatus comprising:

an endless conveying belt conveying the transfer sheet, said conveying belt being driven by a drive roller;

a plurality of image forming units arranged along said conveying belt, each of said image forming units transferring a color component image on the transfer sheet and also transferring a register mark on said conveying belt; and a register mark detecting sensor located along said conveying belt for detecting the register mark on said conveying belt, wherein a distance between said register mark detecting sensor and one of said plurality of image forming units adjacent to said register mark detecting sensor is a multiple of an integer of a circumference of said drive roller; and a distance between adjacent ones of said plurality of image forming units is a multiple of an integer of the circumference of said drive roller.

2. The image forming apparatus as claimed in claim 1, further comprising a rotational force transmitting mechanism which includes a motor and an intermediate rotational member so that a rotational force of said motor is transmitted to said drive roller of said conveying belt via said intermediate rotational member, wherein said motor and said intermediate rotational member are rotated a multiple of an integer of turns while said drive roller rotates a single turn.

3. The image forming apparatus as claimed in claim 1, wherein the distance between said register mark detecting sensor and one of said plurality of image forming units adjacent to said register mark detecting sensor is equal to the circumference of said drive roller, and the distance between adjacent ones of said plurality of image forming units is equal to the circumference of said drive roller.

4. The image forming apparatus as claimed in claim 1, wherein said plurality of image forming units are located on one side of a loop of said conveying belt, and said register mark sensor is located on an opposite side of the loop of said conveying belt.

5. An image forming apparatus for forming a multi-color image formed by transferring and superimposing a plurality of color component images on a transfer sheet, said image forming apparatus comprising:

an endless conveying belt conveying the transfer sheet, said conveying belt being driven by a drive roller;

a plurality of image forming units arranged along said conveying belt, each of said image forming units transferring a color component image on the transfer sheet and also transferring a register mark on said conveying belt;

a register mark detecting sensor located along said conveying belt for detecting the register mark on said conveying belt; and a control unit controlling said image forming units so that one of said image forming units forms a first register mark and a second register mark a first predetermined distance away from said first register mark and another one of said image forming units forms a third register mark and a fourth register mark so that said third register mark is formed a second predetermined distance away from said first register mark and said fourth register mark is formed a second predetermined distance away from said second register mark, said first predetermined distance being substantially equal to a distance corresponding to a n/2 rotation of said driving roller, n being an integer, wherein an amount of offset of registration of color component images transferred by said image forming units is determined based on an average value of a first amount of offset and a second amount of offset, said first amount of offset being detected based on a pair of said first register mark and said third register mark, said second amount of offset being detected based on said second register mark and said fourth register mark.

6. The image forming apparatus as claimed in claim 5, wherein said first distance is equal to a ½ rotation of said driving roller.

7. The image forming apparatus as claimed in claim 5, wherein each of said first, second, third and fourth register marks comprises a first mark and a second mark a third predetermined distance away from said first mark, said first mark extending in a direction perpendicular to a direction of movement of said conveying belt, said second mark extending in a direction inclined with respect to the direction of movement of said conveying belt.

8. An image forming apparatus for forming a multi-color image formed by transferring and superimposing a plurality of color component images on a transfer sheet, said image forming apparatus comprising:

an endless conveying belt conveying the transfer sheet, said conveying belt being driven by a drive roller in a first direction corresponding to a direction of conveyance of the transfer sheet;

a plurality of image forming units arranged along said conveying belt, each of said image forming units transferring a color component image on the transfer sheet and also transferring a register mark on said conveying belt;

a register mark detecting sensor unit located along said conveying belt for detecting the register mark on said conveying belt, said register mark detecting sensor unit comprising a first register mark detecting sensor and a second register mark detecting sensor arranged along a direction of movement of said conveying belt, said second register mark detecting sensor spaced apart from said first register mark detecting sensor by a predetermined short distance; and a control unit controlling said image forming units so that a first register mark is formed by one of said image forming units and a second register mark is formed by another one of said image forming units so that said second register mark is spaced apart from said first register mark by a distance substantially equal to said predetermined short distance, wherein said first register mark and said second register mark are detected by said first register mark sensor and said second register mark sensor substantially at the same time so that an amount of offset of registration of color component images transferred by said image forming units is determined based on a time difference between a detection of said first register mark and a detection of said second register mark.

9. The image forming apparatus as claimed in claim 8, wherein said first register mark comprises a first mark extending in a second direction perpendicular to the first direction, a second mark extending in a direction inclined with respect to the first direction and a third mark extending in the second direction, said second mark spaced apart from said first mark by a distance equal to said predetermined short distance of said register mark detecting sensor unit, said third mark spaced apart from said first mark by a distance corresponding to four times said predetermined short distance;

said second register mark comprises a fourth mark extending in a second direction perpendicular to the first direction, a fifth mark extending in a direction inclined with respect to the first direction and a sixth mark extending in the second direction, said fifth mark spaced apart from said fourth mark by a distance equal to said predetermined short distance of said register mark detecting sensor unit, said sixth mark spaced apart from said fourth mark by a distance corresponding to four times said predetermined short distance; and said fourth mark of said second register mark being spaced apart from said first mark of said first register mark by a distance corresponding to two times said predetermined short distance.

* * * * *